US006148172A

United States Patent [19]

Kanda et al.

[11] Patent Number: 6,148,172

[45] Date of Patent: Nov. 14, 2000

[54] IMAGE FORMING APPARATUS HAVING MEANS FOR ENHANCING ACCURACY OF CONVEYANCE OF RECORDING SHEETS

[75] Inventors: Takanori Kanda; Akira Kosugi; Keisuke Tanaka; Daisuke Ueda; Akitoshi Matsubara; Minoru Asakawa; Jun Yokobori; Chikatsu Suzuki; Takaaki Sakai; Junji Sato; Yoshinao Kitahara, all of Hachioji, Japan

[73] Assignee: Konica Corporation, Tokyo, Japan

[21] Appl. No.: 09/406,378

[22] Filed: Sep. 27, 1999

[30] Foreign Application Priority Data

Oct. 9, 1998 [JP] Japan ..... 10-287939
Dec. 11, 1998 [JP] Japan ..... 10-352849

[51] Int. Cl.[7] ..... G03G 15/00

[52] U.S. Cl. ..... 399/391; 271/9.11; 271/242; 399/395; 399/396

[58] Field of Search ..... 399/388, 391, 399/381, 395, 396, 43, 38, 107, 110; 271/9.01, 9.11, 9.13, 188, 242, 272, 273

[56] References Cited

U.S. PATENT DOCUMENTS 3,963,339 6/1976 Taylor et al. ..... 399/396
5,043,771 8/1991 Shibata et al. ..... 399/396
5,057,874 10/1991 Miyazaki et al. ..... 399/396
5,159,393 10/1992 Hiroshima et al. ..... 399/313
5,355,206 10/1994 Maruyama et al. ..... 399/396
5,418,604 5/1995 Nagakura et al. ..... 399/395 X
5,933,697 8/1999 Onodera et al. ..... 399/388 X
5,991,556 11/1999 Yamashita ..... 399/391 X

FOREIGN PATENT DOCUMENTS 7-172639 7/1995 Japan .
10-329984 12/1998 Japan .

*Primary Examiner*—Sophia S. Chen
*Attorney, Agent, or Firm*—Frishauf, Holtz, Goodman, Langer & Chick, P.C.

[57] ABSTRACT

An image forming apparatus is provided with a plurality of storing units for storing respective recording materials of various sizes; a plurality of feeding members for feeding out the recording materials from each of the storing units; a conveyance path along which the recording materials being fed out by each of the feeding members are conveyed; a plurality of conveying members for conveying the recording materials along the conveyance path; an image forming section for forming an image on the recording materials conveyed along the conveyance path; and a plurality of first regulators provided at respective predetermined positions with respect to corresponding ones of each of the storing units for regulating at least a maximum size of the various sizes of the recording materials while at least at a part of each of the recording materials is fed out from the respective corresponding storing units.

24 Claims, 11 Drawing Sheets

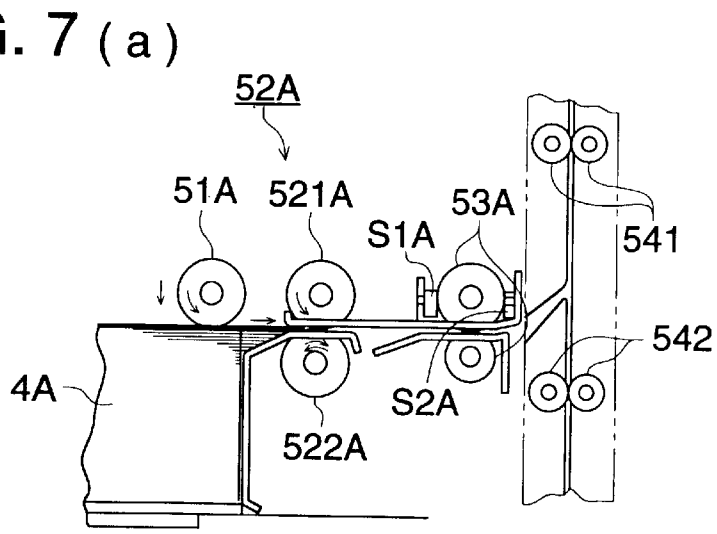
FIG. 7 (a)
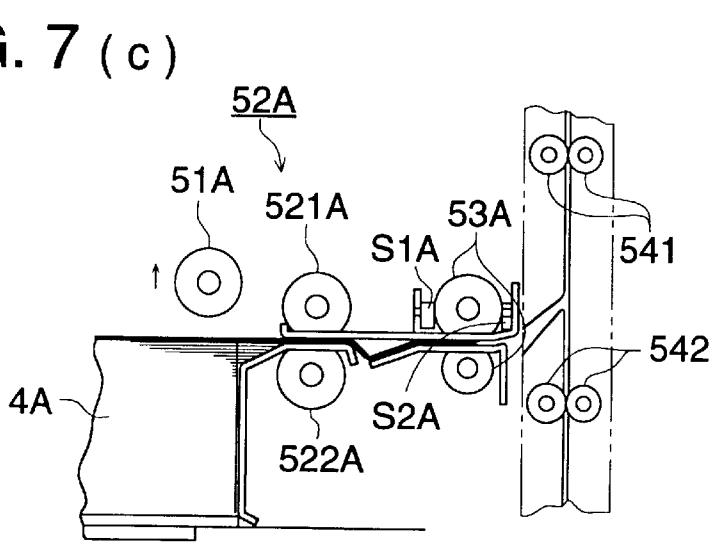
FIG. 7 (b)
FIG. 7 (c)
FIG. 7 (d)

IMAGE FORMING APPARATUS HAVING MEANS FOR ENHANCING ACCURACY OF CONVEYANCE OF RECORDING SHEETS

BACKGROUND OF THE INVENTION

The present invention relates to an image forming apparatus having therein a recording material housing means which houses recording materials, an image forming means which forms an image on a recording material that is in transit, and a conveyance means which conveys a recording material from the recording material housing means to the image forming means along a conveyance path.

In the image forming apparatus such as a copying machine of an electrophotographic type and a printer, a recording material housed in a recording material housing means is conveyed by a conveyance means, and image forming is conducted by an image forming means on the recording material thus conveyed. In recent years, there has been a strong demand for improvement in the number of sheets for image forming per unit time (productivity), and speedup of the conveyance speed (hereinafter referred to as "process speed") for the recording material in the case of forming images with an image forming means is now being sought, accordingly.

For making a process speed higher, however, it is necessary to increase strength of a housing of an image forming apparatus, which results in a cost increase. Further, when a process speed is higher, a time lag in the conveyance timing makes misregistration of an image on a recording material more likely to occur. Since the frictional resistance between a recording material and a conveyance path is increased and an extent of slippage between a recording material and a conveying member is increased by the higher process speed, in particular, a time lag in the conveyance timing for the recording material and an extent of sheet skewing are increased. In addition, when complying with many types of recording materials, a time lag in conveyance timing and an extent of sheet skewing vary depending on the frictional force between a recording material and a conveyance path and that between the recording material and a conveying member These frictional forces are different from each other. Furthermore, when plural means for loading recording materials are provided for complying with many types of recording materials, a length of the conveyance path varies depending on each recording material loading means, which makes a time lag in conveyance timing and an extent of sheet skewing to be different. When increasing the number of images formed in the unit time by gathering the process speed, therefore, it is necessary to enhance accuracy of conveyance of recording sheets for forming images with high quality.

For enhancing productivity of images, on the other hand, there is also a method to narrow intervals for conveying recording materials, in addition to gathering of the process speed. However, even when the conveyance intervals are narrowed, it is still necessary to enhance accuracy of conveyance for recording sheets, because there is a high possibility, if the conveyance intervals are narrowed, that a trailing edge portion of a preceding recording sheet and a leading edge portion of a succeeding recording sheet are superposed on each other and that a paper jam will be caused when the conveyance timing for recording sheets is different between a preceding recording sheet and a succeeding recording sheet.

Namely, regardless of whichever method is employed, it is necessary, for raising productivity, to enhance the accuracy of conveyance of recording sheets. After studying the location where a time lag in conveyance timing for recording sheets and sheet skewing tend to be caused firstly, it was found that the location was a sheet feeding section where a recording sheet is taken out of a recording sheet loading means, and that time lag and sheet skewing were caused by frictional force between recording materials. It was also found that the location which tends to cause a time lag and sheet skewing secondly was a portion in the conveyance path where there is a curve and that time lag and sheet skewing were caused by frictional force between the recording material and the conveyance path. The time lag and skewing caused in the aforesaid locations can be corrected relatively easily if they are corrected in the early stage, but when they are not corrected in the early stage, they are increased by the conveyance thereafter to become difficult to be corrected easily, resulting in paper jams which tend to stop an apparatus.

SUMMARY OF THE INVENTION

With the background described above, an object of the invention is to provide an image forming apparatus wherein a time lag in conveyance timing for recording materials and sheet skewing can be corrected in an early stage and productivity of images can be enhanced.

The objects mentioned above can be attained by the following structures.

An image forming apparatus comprises:

- a plurality of storing units for storing respective recording materials of various sizes;
- a plurality of feeding members for feeding out the recording materials from each of the storing units;
- a conveyance path along which the recording materials being fed out by each of the feeding members are conveyed;
- a plurality of conveying members for conveying the recording materials along the conveyance path;
- an image forming section for forming an image on the recording materials conveyed along the conveyance path; and
- a plurality of first regulators provided at respective predetermined positions with respect to corresponding ones of each of the storing units for regulating at least a maximum size of the various sizes of the recording materials while at least at a part of each of the recording materials is fed out from the respective corresponding storing units Owing to the structure mentioned above, a time lag in conveyance timing for recording materials and sheet skewing are corrected in an early stage after they are caused, and thereby, they can be corrected surely relatively easily, and productivity of images can be enhanced.

Further, the objects mentioned above can be attained by the following preferable structures.

An image forming apparatus having therein a recording material housing means which houses recording materials, an image forming means which conducts image forming on a recording material and a conveyance means which conveys a recording material from the recording material housing means to the image forming means along a conveyance path, wherein the conveyance means has plural stopper means each being hit by the recording material conveyed on the conveyance path.

Due to the structure stated above, a recording material conveyed by the conveyance means is made to hit plural stopper means, and thereby, dispersion of conveyance can be reduced sharply, which makes it possible to conduct excellent image forming at an accurate position on the recording material. In particular, even in the case of achievement of speedup, productivity can be improved because dispersion of conveyance is restrained.

An image forming apparatus having therein a recording material housing means which houses recording materials, an image forming means which conducts image forming on a recording material and a conveyance means which conveys a recording material from each of the plural recording material housing means to the image forming means along a conveyance path, wherein the conveyance means has, corresponding to the plural recording material housing means, plural stopper means each being hit by the recording material conveyed from each recording material housing means.

Due to the structure stated above, it is possible to restrain dispersion of conveyance at the position where the dispersion of conveyance tends to be caused most likely.

An image forming apparatus having therein a recording material housing means which houses recording materials, an image forming means which conducts image forming on a recording material and a conveyance means which conveys a recording material from the recording material housing means to the image forming means along a conveyance path, wherein the conveyance means has the first stopper means which is hit by the recording material conveyed from the recording material housing means, while, the recording material housing means and the first stopper means are unitized to be capable of being drawn out of the image forming apparatus solidly.

Due to the structure stated above, when a sheet is jammed, it is possible to draw out, leaving the jammed sheet as it is, so that the jammed sheet may be cleared easily and surely.

A recording material conveyance method having therein a recording material housing means which houses recording materials, an image forming means which conducts image forming on a recording material and a conveyance means which conveys a recording material from the recording material housing means to the image forming means along a conveyance path, wherein the step to reconvey a recording material after the recording material conveyed by the conveyance means is made to hit and at least the leading edge of the recording material is stopped, is conducted plural times.

Due to the structure stated above, it is possible to reduce sharply dispersion of conveyance and thereby to conduct excellent image forming at an accurate position on a recording material because the recording material conveyed by the conveyance means is made to hit several times. In particular, even in the case of achievement of speedup, productivity can be improved because dispersion of conveyance is restrained.

An image forming apparatus having therein a recording material housing means which houses recording materials, an image forming means which conducts image forming on a recording material and a conveyance means which conveys a recording material from the recording material housing means to the image forming means along a conveyance path, wherein the conveyance means has on the conveyance path a plurality of skewing correction means each correcting skewing of the recording material which is being conveyed.

Due to the structure stated above, it is possible to reduce sharply the skewing of a recording material caused by conveyance, because skewing of the recording material conveyed by the conveyance means is corrected plural times by plural skewing correction means, and even in the case of achievement of speedup, it is possible to conduct excellent image forming at an accurate position on the recording material.

An image forming apparatus having therein a plurality of recording material housing means which house recording materials, an image forming means which conducts image forming on a recording material and a conveyance means which conveys a recording material from each of the plural recording material housing means to the image forming means along a conveyance path, wherein the conveyance means has on the conveyance path a plurality of first skewing correction means which correct skewing of a recording material conveyed from each recording material housing means, corresponding to the plural recording material housing means.

Due to the structure stated above, it is possible to correct skewing of a recording material at the position where the skewing of the recording material tends to be caused most likely.

An image forming apparatus having therein a recording material housing means which houses recording materials, an image forming means which conducts image forming on a recording material and a conveyance means which conveys a recording material from the recording material housing means to the image forming means along a conveyance path, wherein the conveyance means has the first skewing correction means which corrects skewing of the recording material conveyed from the recording material housing means, while, the recording material housing means and the first skewing correction means are unitized to be capable of being drawn out of the image forming apparatus solidly.

Due to the structure stated above, when a sheet is jammed, it is possible to draw out, leaving the jammed sheet as it is, so that the jammed sheet may be cleared easily and surely.

A recording material conveyance method having therein a recording material housing means which houses recording materials, an image forming means which conducts image forming on a recording material and a conveyance means which conveys a recording material from the recording material housing means to the image forming means along a conveyance path, wherein the step to correct skewing of a recording material conveyed by the conveyance means is conducted plural times.

Due to the structure stated above, a recording material conveyed by the conveyance means is corrected plural times in terms of skewing, and thereby, it is possible to reduce sharply the skewing of a recording material caused by the conveyance, and even in the case of achievement of speedup, for example, image forming can be conducted at an accurate position on a recording material.

An image forming apparatus having therein a recording material housing means which houses recording materials, an image forming means which conducts image forming on a recording material and a conveyance means which conveys a recording material from the recording material housing means to the image forming means along a conveyance path, wherein the conveyance means has at least one of the first stopper means which is hit by a recording material and stops at least the leading edge of the recording material and then reconveys the recording material and the first skewing correction means which corrects skewing of the recording material conveyed, and the second stopper means which is provided at the downstream side of the first stopper means or the first skewing correction means in the direction of conveyance of a recording material and is hit by the recording material conveyed, then stops at least the leading edge of the recording material and then reconveys the recording material.

Due to the structure stated above, a recording material conveyed by the conveyance means is subjected by the first stopper means or the first skewing correction means to control of dispersion of conveyance or to correction of skewing, and then dispersion of conveyance is controlled by the second stopper means, whereby, excellent image forming can be conducted at an accurate position on the recording material.

Furthermore, the objects mentioned above can be attained by the following preferable structures.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means is controlled so that a recording material is conveyed from the recording material housing means at the speed higher than the aforesaid process speed, and then is conveyed to the image forming means at the process speed mentioned above.

Due to the structure stated above, it is possible to shorten intervals of recording materials and thereby to improve productivity without increasing the process speed so much.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means mentioned above has the first stopper means which is hit by a recording material fed out of the recording material housing means for reconveyance of the recording material, a first loop forming means which continues conveying the recording material when the recording material hits the first stopper means on the upstream side in the direction of conveyance of the recording material and thereby forms a loop of the recording material, a second stopper means which reconveys the recording material when the conveyed recording material hits the first stopper means on the downstream side in the direction of conveyance of the recording material, and a second loop forming means which forms a loop of the recording material by continuing conveyance of the recording material when the recording material hits the second stopper means on the downstream side in the direction of conveyance of the recording material for the first stopper means and on the upstream side in the direction of conveyance of the recording material for the second stopper means, and each of the first stopper means, the second stopper means, the first loop forming means and the second loop forming means is controlled to be driven separately from others.

Due to the structure stated above, the stopper means is hit by the recording material at least twice and a loop of the recording material is formed at least twice. Therefore, conveyance timing and dispersion can be controlled, the recording material can be conveyed accurately, and control for driving thereof can be made easy.

An image forming apparatus having therein a recording material housing means which houses recording materials, an image forming means which conducts image forming on a recording material that is being conveyed, and a conveyance means which conveys a recording material from the recording material housing means to the image forming means along a conveyance path, wherein the conveyance path has the first conveyance path through which a recording material is fed out of the recording material housing means, an intermediate conveyance path through which the recording material fed out of the first conveyance path is conveyed and the second conveyance path through which the recording material conveyed through the intermediate conveyance path is conveyed to the image forming means, the conveyance means has, on the first conveyance path, a feed-out means which separates and feeds out recording materials housed in the recording material housing means one by one and a first stopping means which is hit by the recording material fed out of the feed-out means and stops it, and the conveyance means is controlled so that when the recording material fed out of the feed-out means hits the first stopper means, feeding out by the feed-out means is continued to make the recording material hitting the first stopper means to form a loop, then the feeding out by the feed-out means is stopped, and after that, conveyance of the recording material is started again by the first stopper means.

Due to the structure stated above, dispersion and skewing in conveyance can be controlled on the first conveyance path where dispersion in conveyance takes place most likely. It is therefore easy to take the timing accurately in the later step, which makes it possible to narrow the intervals of recording materials and thereby to further realize higher productivity.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means has, on the conveyance path, a second stopper means which is hit by the recording material and stops at least the leading edge of the recording material, and then, reconveys it, and the conveyance means is controlled when it conveys plural sheets of recording materials so that the distance between the trailing edge of the preceding recording material which is reconveyed by the stopper means and the leading edge of the succeeding recording material conveyed to follow the preceding recording material in the case reconveyance by the stopper means has been started may be longer than the distance between the trailing edge of the preceding recording material and the leading edge of the succeeding recording material in the case where the preceding recording material has passed through the stopper means.

Due to the structure stated above, it is possible to make the succeeding recording material to hit the stopper means earlier, and thereby to take the conveyance timing accurately and to narrow intervals of recording materials reconveyed from the stopper means, thus, it is possible to improve productivity.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means has, on the conveyance path, a second stopper means which is hit by the recording material and stops at least the leading edge of the recording material, and then, reconveys it, and the conveyance means is controlled when it conveys plural sheets of recording materials so that the distance between the trailing edge of the preceding recording material reconveyed by the stopper means and the leading edge of the succeeding recording material conveyed to follow the preceding recording material may be shortened with the lapse of time.

Due to the structure stated above, it is possible to make the succeeding recording material to hit the stopper means earlier, and thereby to take the conveyance timing accurately and to narrow intervals of recording materials reconveyed from the stopper means, thus, it is possible to improve productivity.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means has a first stopper means which is hit by a recording material and can stop at least the leading edge of the recording material and then reconvey it, on the conveyance path, and a second stopper means which is hit by a recording material and can stop at least the leading edge of the recording material and then reconvey it, on the conveyance path at the downstream side of the first stopper means in the direction of conveyance of a recording material, and the conveyance means is controlled, when it conveys plural recording materials, so that the first recording material out of them may be conveyed without being stopped by the first stopper means.

Due to the structure stated above, the second recording material is stopped at least twice and a loop is formed at least twice for the second recording material. Therefore, it is possible to control the timing for conveyance and dispersion, and thereby to covey the recording material accurately. In addition to that, it is possible to expedite conveyance of the first recording material and to expedite image formation on the first recording material accordingly.

An image forming apparatus having therein a recording material housing means which houses recording materials, an image forming means which conducts image forming on a recording material that is being conveyed at the prescribed process speed, and a conveyance means which conveys a recording material from the recording material housing means to the image forming means along a conveyance path, wherein the conveyance means has a first stopper means which is hit by a recording material and can stop at least the leading edge of the recording material and then reconvey it, on the conveyance path, and a second stopper means which is hit by a recording material and can stop at least the leading edge of the recording material and then reconvey it, on the conveyance path at the downstream side of the first stopper means in the direction of conveyance of a recording material, and a period of time for stop of the recording material by the first stopper means is longer than that for stop of the recording material by the second stopper means.

Due to the structure stated above, stopping is conducted at least twice and a loop is formed at least twice. Therefore, it is possible to control the timing for conveyance and dispersion, and thereby to covey the recording material accurately. In addition to that, the time for the stop by the stopper means at the upstream side is longer, and therefore, dispersion in conveyance can be eliminated early enough at the upstream side where dispersion in conveyance tends to take place, thus, accurate conveyance can be carried out.

BRIEF DESCRIPTION OF THE DRAWINGS

FIGS. 7(*a*) to 7(*d*) are illustrations, in the second embodiment, which illustrates operations in the vicinity of a recording sheet housing means.

DETAILED DESCRIPTION OF THE PREFERRED EMBODIMENT

Figure 1:
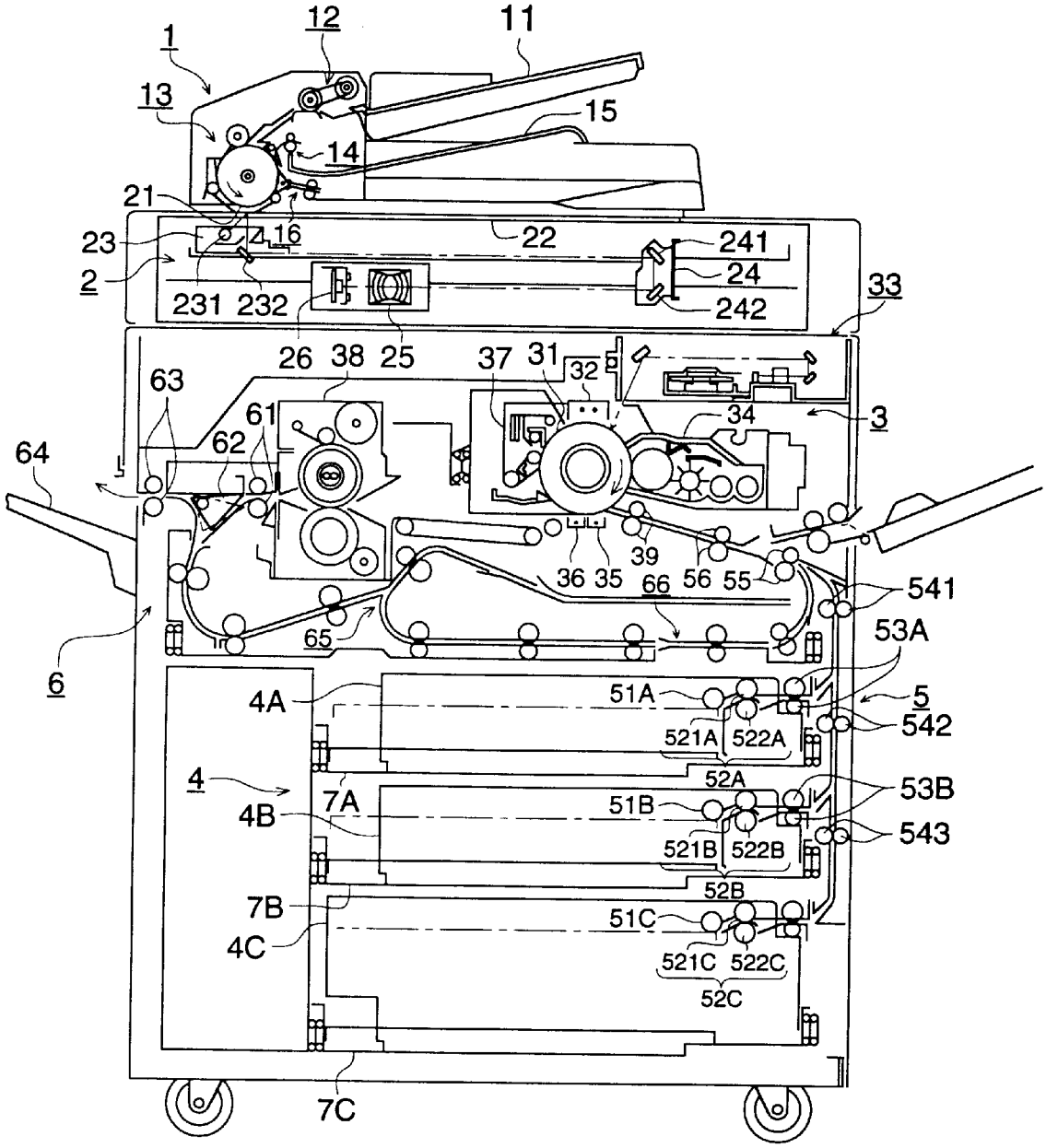
FIG. 1 is a schematic sectional view of a copying machine.

An embodiment of the invention wherein the invention is applied to an electrophotographic copying machine representing an image forming apparatus will be explained as follows, referring to the drawings. First, the total structure and schematic process of the copying machine will be explained based on FIG. 1 which is a schematic sectional view of the copying machine.

The copying machine in the present embodiment has automatic document feeder 1 on the upper part of the main body of the copying machine, and has image reading unit 2, image forming means 3, recording sheet housing means 4, conveyance means 5 and sheet ejection/sheet refeeding means 6 inside the main body of the copying machine.

The automatic document feeder 1 is a unit which is provided on the upper portion of the copying machine main body, and feeds out documents one by one, then conveys it to the position for reading images of a document, and ejects the document whose images have been read. The automatic document feeder 1 has therein document placement stand 11 on which a document is placed, document separation means 12 which separates documents placed on the document placement stand 11 one by one, document conveyance means 13 which conveys the document separated by the document separation means 12, document ejection means 14 which ejects the document conveyed by the document conveyance means 13, document ejection stand 15 which catches the document ejected by the document ejection means 14 and holds it, and document reversing means 16 which reverses the document upside down when reading images on both sides of the document.

A plurality of documents placed on the document placement stand 11 are separated by the document separation means 12 to be conveyed one by one. The document separated and conveyed by the document separation means 12 is conveyed by the document conveyance means 13 so that images on the document are read by the image reading unit 2 provided at the lower part, through slit 21. The document on which the images have been read is ejected to the document ejection stand 15 by the document ejection means 14. Incidentally, when reading images on both sides of the document, the document on which the images on its obverse side have been read is reversed upside down by the document reversing means 16, and is conveyed again by the document conveyance means 13 so that images on the reverse side of the document are read by the image reading unit through slit 21. The document on which the images on its reverse side have been read is ejected to the document ejection stand 15 by the document ejection means 14. The steps stated above are repeated for the number of times equivalent to the number of documents placed on the document placement stand 11 so that images on the document are read.

The automatic document feeder 1 is structured to be swung solidly, and there is arranged so that a document can be placed directly on platen glass 22 when the automatic document feeder 1 is erected to make the portion on the platen glass 22 to be opened. Incidentally, in the arrangement in the present embodiment, images on a document are read while the document is being conveyed by the document conveyance means 13. However, it is also possible to arrange so that images are read after the document conveyed by the document conveyance means 13 is kept stationary on the platen glass 22.

The image reading unit 2 is a means to read images on a document and to obtain image data, and it is provided at the upper portion in the copying machine main body. This image reading unit 2 has therein slit 21 which is a slit-shaped opening through which the images on the document conveyed by the document conveyance means 13 of the automatic document feeder 1 are read, platen glass 22 representing a document stand on which the document is directly placed (stationary), first mirror unit 23 wherein lamp 231 representing a light source for irradiating a document and first mirror 232 to reflect the light reflected on the document are unified solidly, V mirror unit 24 wherein second mirror 241 for reflecting the light from the first mirror 232 and third mirror 242 are unified solidly, image forming lens 25 representing an image forming means for making reflected light from a document on the slit 21 or on the platen glass 22 to form an image on CCD 26 stated later, and linear CCD 26 representing an image reading means which photoelectrically converts an optical image formed by the image forming lens 25 and thereby obtains image information.

When reading a document conveyed by the automatic document feeder 1 with the image reading unit 2, the first mirror unit 23 is positioned below the slit 21 as shown in FIG. 1, with regard to the first mirror unit 23 and V mirror unit 24. Then, the document conveyed by the document conveyance means 13 along the slit 21 is irradiated by the lamp 231, and the light reflected on the document enters CCD 26 through the first mirror 232, the second mirror 241, the third mirror 242 and image forming lens 25. In the CCD, the incident light is subjected to photoelectrical conversion, and images on the document in the main scanning direction (the direction perpendicular to the page in FIG. 1) are read, while on the other hand, images on the entire page of the document can be read because the document is moved in the sub-scanning direction by the document conveyance means 13. Image information obtained through reading in the CCD 26 is subjected to appropriate image processing, and is supplied to laser writing system 33 which will be explained later.

When a document is placed directly on the platen glass 22, it is possible to read images on the document, while moving the first mirror unit 23 and V mirror unit 24 along the platen glass in the direction toward the right side in FIG. 1.

Image forming means 3 is a means to form an image on a recording sheet representing a recording material which is being conveyed at prescribed process speed Vp established in advance based on image data obtained by image reading unit 2. The image forming means 3 in the present embodiment is one to form an image by the use of an electrophotographic process. The image forming means 3 has therein photoreceptor drum 31 representing an image carrier which has a photoconductive photosensitive layer and carries toner images, charging unit 32 which charges the photoreceptor drum 31 uniformly, laser writing system 33 representing an exposure means which conducts exposure on the photoreceptor drum 31 based on image information obtained through reading in CCD 26 and forms a latent image, developing unit 34 which develops the latent image on the photoreceptor drum 31 and forms a toner image, transfer unit 35 which transfers the toner image carried on the photoreceptor drum 31 onto a recording sheet conveyed separately, separation unit 36 which separates the recording sheet having thereon the transferred toner image from the photoreceptor drum 31, cleaning means 37 which removes toner remaining on the photoreceptor drum 31 after the transfer, and fixing means 38 which fixes the toner image on the recording sheet. These charging unit 32, laser writing system 33, developing unit 34, transfer unit 35, separation unit 36 and cleaning means 37 are arranged around the photoreceptor drum 31.

The photoreceptor drum 31 is rotated in the arrowed direction by an unillustrated driving means, and is charged uniformly by the charging unit 32. Then, a latent image is formed on the photoreceptor drum 31 by the laser writing system 33, in which exposure is started in synchronization with the leading edge of a recording sheet fed out of registration roller 56 which will be explained later, and the latent image is developed by developing unit 34, thus, a toner image based on image information obtained by CCD 26 through reading is formed. The toner image thus formed is transferred by transfer unit 35 onto a recording sheet conveyed separately. The recording sheet having thereon the transferred toner image is separated from photoreceptor drum 31 by separation unit 36 and is conveyed to fixing means 38 where the toner image is fixed on the recording sheet by heating and pressurizing. On the other hand, the photoreceptor drum 31 from which the toner image has been transferred onto the recording sheet further rotates so that toner remaining on the photoreceptor drum 31 may be removed by cleaning means 37 and the photoreceptor drum 31 may be prepared for the following image forming.

In the present embodiment, pre-drum conveyance roller 39 which conveys a recording sheet fed out of registration roller 56 is provided in the vicinity of photoreceptor drum 31 between the photoreceptor drum 31 and the registration roller 56 so that the conveyance power for the recording sheet may be enhanced. Further, for the purpose of conveying the recording sheet separated by separation unit 36, there are provided a conveyance roller (having no symbol) which supports the lower side (which is opposite to the side where images are formed) of the recording sheet to convey it and a belt (having no symbol) between separation unit 36 and fixing means 38.

Recording sheet housing means 4 is a recording material housing means which houses a plurality of recording sheets which are stacked. In the present embodiment, there are provided plural recording sheet housing means 4, namely, first recording sheet housing means 4A, second recording sheet housing means 4B and third recording sheet housing means 4C, and these recording sheet housing means 4A–4C are arranged under image forming means 3 on a multi-deck basis. Recording materials housed in these recording sheet housing means 4A–4C are represented by various media including OHT in addition to recording sheets such as a plain paper and a recycled sheet.

Conveyance means 5 is one which conveys a recording material from recording sheet housing means 4 to image forming means 3, and it is structured so that it can convey recording sheets housed in each of recording sheet housing means 4A–4C to the image forming means 3. Concrete structure and operations of the conveyance means 5 will be described in detail afterwards.

Sheet ejection/sheet refeeding means 6 is a means which conducts sheet ejection or sheet refeeding for the recording sheet which has been conveyed by the conveyance means 5 and has been subjected to image forming by the image forming means 3. This sheet ejection/sheet refeeding means 5 has therein post-fixing ejection roller 61 which ejects the recording sheet on which a toner image has been fixed from fixing means 38, switching means 62 which switches a conveyance path depending on the occasion to eject the recording sheet ejected by the post-fixing ejection roller 61 out of the machine, and the occasion to eject after reversing upside down, or to refeed a sheet for image forming on the reverse side of the sheet, sheet ejection roller 63 for ejecting a recording sheet out of the machine, sheet ejection tray 64 provided on the side of the copying machine, on which the recording sheet ejected by the sheet ejection roller 63 is stacked, reversing means 65 which reverses the refed recording sheet upside down, and sheet refeeding means 66 which refeeds the recording sheet reversed by the reversing means 65 to the image forming means 3.

When ejecting the recording sheet having thereon formed images as it is, namely, with its side on which the images are formed facing upward, the recording sheet is ejected by the post-fixing ejection roller 61 and the sheet ejection roller 63 to the sheet ejection tray 64 located outside the machine, with the switching means 62 located at the position shown with one-dot chain lines in FIG. 1. When ejecting the recording sheet having thereon formed images after reversing it, namely, with its side on which the images are formed facing downward, the switching means 62 is located at the position shown with solid lines in FIG. 1, and the recording sheet conveyed by the post-fixing ejection roller 61 is conveyed temporarily toward the reversing means 65, and then the conveyance direction is reversed after the recording sheet has passed the switching means 62 so that the recording sheet is ejected to the sheet ejection tray 64 outside the machine by sheet ejection roller 63. On the other hand, when forming images on the reverse side of the recording sheet, the switching means 62 is located at the position shown with solid lines in FIG. 1, and the recording sheet conveyed by the post-fixing ejection roller 61 is conveyed to the reversing means 65 to be subjected to switchback operation and to be reversed upside down by the reversing means 65, and is conveyed to sheet refeeding means 66. The recording sheet conveyed up to the sheet refeeding means 66 joins the conveyance path between loop forming roller 55 and intermediate conveyance roller 541 both described later, and is conveyed to image forming means 3 in the same way as in sheet feeding from recording sheet housing means 4.

Figure 2:
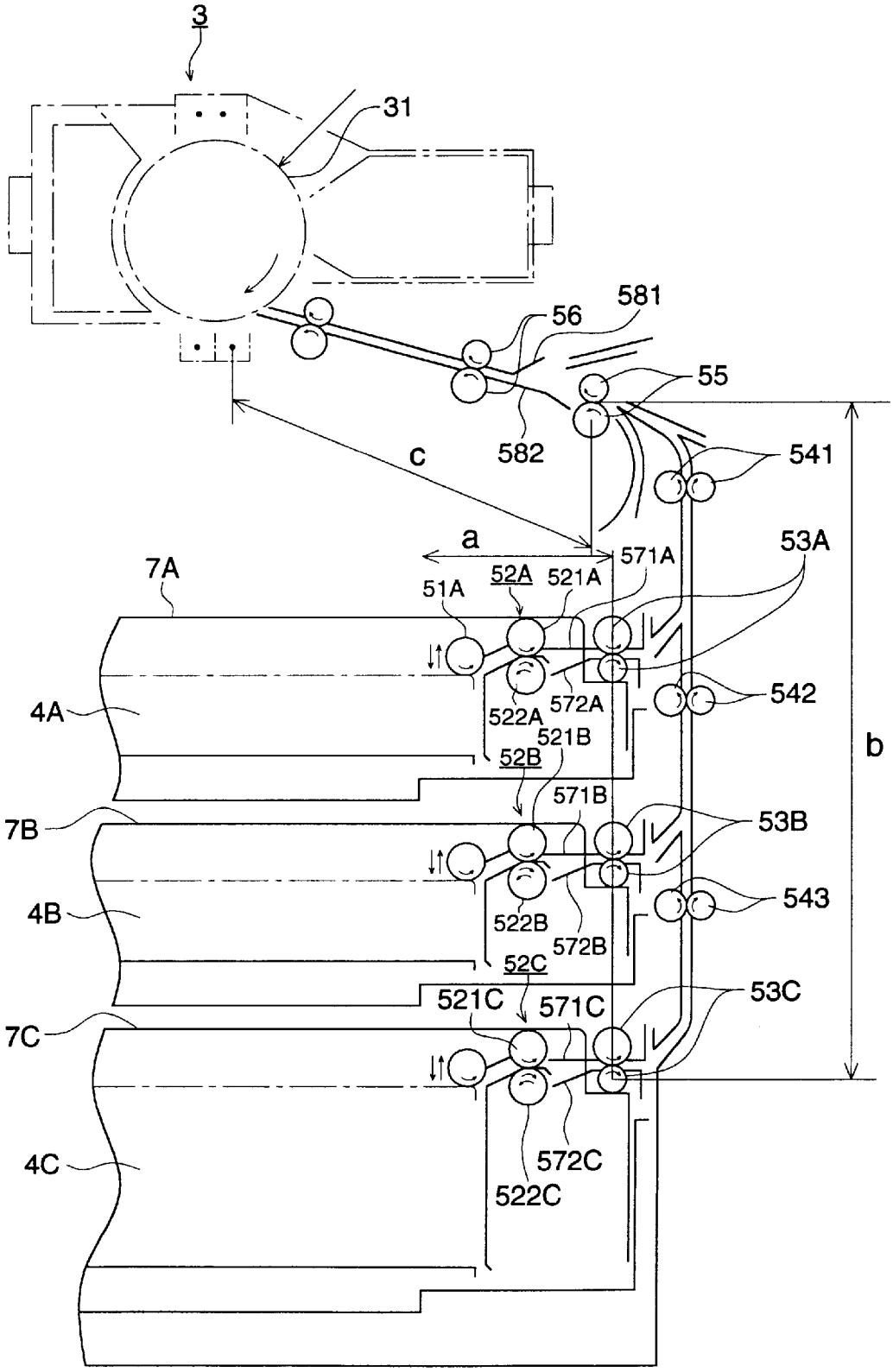
FIG. 2 is a diagram, in the first embodiment, wherein a conveyance path through which a recording sheet is conveyed by a conveyance means is enlarged illustratively.

Next, structure and operations of the conveyance means 5 applied in the present embodiment will be explained based on FIG. 2 which is a diagram wherein a conveyance path through which a recording sheet is conveyed by conveyance means 5 is enlarged illustratively and FIG. 3 which is a perspective view wherein the first unit is drawn out.

First, the conveyance path through which a recording sheet is conveyed by conveyance means 5 will be explained. The conveyance of the recording sheet by the conveyance means 5 is conducted along a conveyance path (having no symbol). Namely, the recording sheet housed in each of recording sheet housing means 4A–4C is conveyed by the conveyance means 5 along the conveyance path having therein first conveyance path a for feeding out the recording sheet from recording sheet housing means 4, intermediate conveyance path b for conveying the recording material fed out through the first conveyance path a, and second conveyance path c for conveying the recording material conveyed through the intermediate conveyance path b to image forming means 3, as shown in FIG. 2. The first conveyance path a is a conveyance path covering from the recording sheet housing means 4 to pre-registration roller 53, and it is a conveyance path pointing to the right side (mostly horizontal direction) in FIG. 2. The intermediate conveyance path b is a conveyance path covering from the pre-registration roller 53 to the loop forming roller 55, and it is a conveyance path going upward vertically in FIG. 2. The second conveyance path c is a conveyance path covering from the loop forming roller 55 to transfer unit 35, and it is a conveyance path pointing to the left side in FIG. 2.

Then, the recording sheet is conveyed through the first conveyance path a, the intermediate conveyance path b and the second conveyance path c in this order. In the present embodiment, the first conveyance path a is provided on each of recording sheet housing means 4A–4C. The intermediate conveyance path b is a conveyance path at least a part of which is used in common. Namely, when the recording sheet from the third recording sheet housing means 4C is on the half way on the intermediate conveyance path b, the recording sheet from the second recording sheet housing means 4B, and further the recording sheet from the first recording sheet housing means 4A join so that the intermediate conveyance path b is used in common. The second conveyance path c is a conveyance path which is used in common for the recording sheet from each of the recording sheet housing means 4A–4C.

Next, each structure (means) of the conveyance means 5 will be explained.

The conveyance means 5 has therein pickup roller 51 representing a feed-out means which is arranged on the upper portion of recording sheet housing means 4 and feeds out a recording sheet housed in the recording sheet housing means 4, separation means 52 (serving also as the first loop forming means) which is composed of fanning conveyance roller 521 and fanning retarding roller 522 for separating the recording sheet fed out by the pickup roller 51 one by one, pre-registration roller 53 representing the first stopper means which temporarily stops the recording sheet separated by the separation means 52 and then restarts the conveyance thereof, plural intermediate conveyance rollers 541–543 representing an intermediate conveyance means conveying the recording sheet conveyed by pre-registration roller 53, loop forming roller 55 representing the second loop forming means which conveys the recording sheet conveyed by the intermediate conveyance roller, registration roller 56 representing the second stopper means which stops the recording sheet conveyed by the loop forming roller 55 and then restarts the conveyance thereof, and plural motors (not shown) representing a driving means which drives each roller.

Incidentally, the first skewing correction means is a means which is composed of pre-registration roller 53 representing the first stopper means and separation means 52 representing the first loop forming means, and corrects sheet skewing by forming a loop on a recording sheet to be conveyed. It is further preferable that loop forming guide 572 which will be described later is provided on the first skewing correction means. Further, the second skewing correction means is a means which is composed of registration roller 56 representing the second stopper means and loop forming roller 55 representing the second loop forming means, and corrects sheet skewing by forming a loop on a recording sheet to be conveyed. It is further preferable that loop forming guide 581 which will be described later is provided on the second skewing correction means.

Each of the recording sheet housing means 4A–4C is provided with pickup roller 51, separation means 52 composed of fanning conveyance roller 521 and fanning retarding roller 522, pre-registration roller 53, first sensor S1 and second sensor S2 both described later, and function of them are all the same for each recording sheet housing means (also structures are the same in the present embodiment). In the drawing, therefore, each of A–C is added to each symbol for indication, but in some cases, a symbol of A–C is not added for the reason of explanation. Even in this case, the same thing can be said for all cases.

Pickup roller 51 is a feed-out means which feeds out a recording sheet housed in recording sheet housing means 4 arranged at the upper portion of the recording sheet housing means 4. The pickup roller 51 is provided to be moved up and down by an unillustrated driving means in FIG. 2, and when it is moved to its lower position, it is positioned on the first conveyance path a to be in contact with the uppermost recording sheet among plural recording sheets housed in the recording sheet housing means 4 so that it is driven by an unillustrated driving means to rotate in the arrowed direction to be capable of feeding out the uppermost recording sheet. When the pickup roller 51 is moved to its upper position, it is far from the recording sheet. Incidentally, the recording sheet housing means 4 is pushed up by a means such as an unillustrated bottom plate so that the uppermost recording sheet among plural recording sheets housed in the recording sheet housing means 4 may always be at the same position.

Separation means 52 is a means which separates a recording sheet fed out of the pickup roller 51 one by one, and it is provided on the first conveyance path a. In the present embodiment, it has fanning conveyance roller 521 and fanning retarding roller 522. The fanning conveyance roller 521 is in contact with the upper face of the recording sheet conveyed, and it is a roller driven by an unillustrated driving means to rotate in the arrowed direction, and it is a roller to convey the recording sheet to pre-registration roller 53 adjoining the downstream side of the recording sheet in the conveyance direction. The fanning retarding roller 522 is a roller incorporated in a torque limiter, and it is a roller to separate the recording sheet fed out of the pickup roller 51 one by one jointly with the fanning conveyance roller 521. Incidentally, this separation means 52 serves also as the first loop forming means which constitutes the first skewing correction means for correcting the skew of the recording sheet as will be explained later.

In the present embodiment, a feed-out means which separates and feeds out recording sheets housed in recording sheet housing means 4 one by one is provided to be divided in terms of function into pickup roller 51 which feeds out a recording material housed in recording sheet housing means 4 and separation means 52 which separates one by one. However, these two may be integrated to be a feed-out means having two functions. For example, when a belt is provided between the pickup roller 51 and fanning conveyance roller 521 so that a fanning retarding roller may be in contact with the belt, it is possible to realize a feed-out means which functions together. In this case, this feed-out means also serves as a first loop forming means which constitutes a first skewing correction means for correcting skewing of a recording sheet.

Pre-registration roller 53 is a first stopper means which is temporarily hit by the recording sheet separated by separation means 52 and starts conveyance again, and it is the so-called registration roller. This pre-registration roller 53 comprises paired rollers which face each other, and it is provided on the first conveyance path a to be capable of being rotated in the arrowed direction by an unillustrated driving means. The pre-registration roller 53 is not rotating when a recording sheet is conveyed by separation means 52 to the pre-registration roller 53, and thereby, the recording sheet thus conveyed hits the pre-registration roller 53 and the leading edge of the recording sheet is stopped. After that, the pre-registration roller 53 starts rotating and the recording sheet is conveyed again by the pre-registration roller 53. By causing the recording sheet to temporarily stop, the pre-registration roller 53 makes it possible to accurately control the timing of the leading edge of the recording sheet, and thereby to control dispersion of conveyance.

Figure 4:
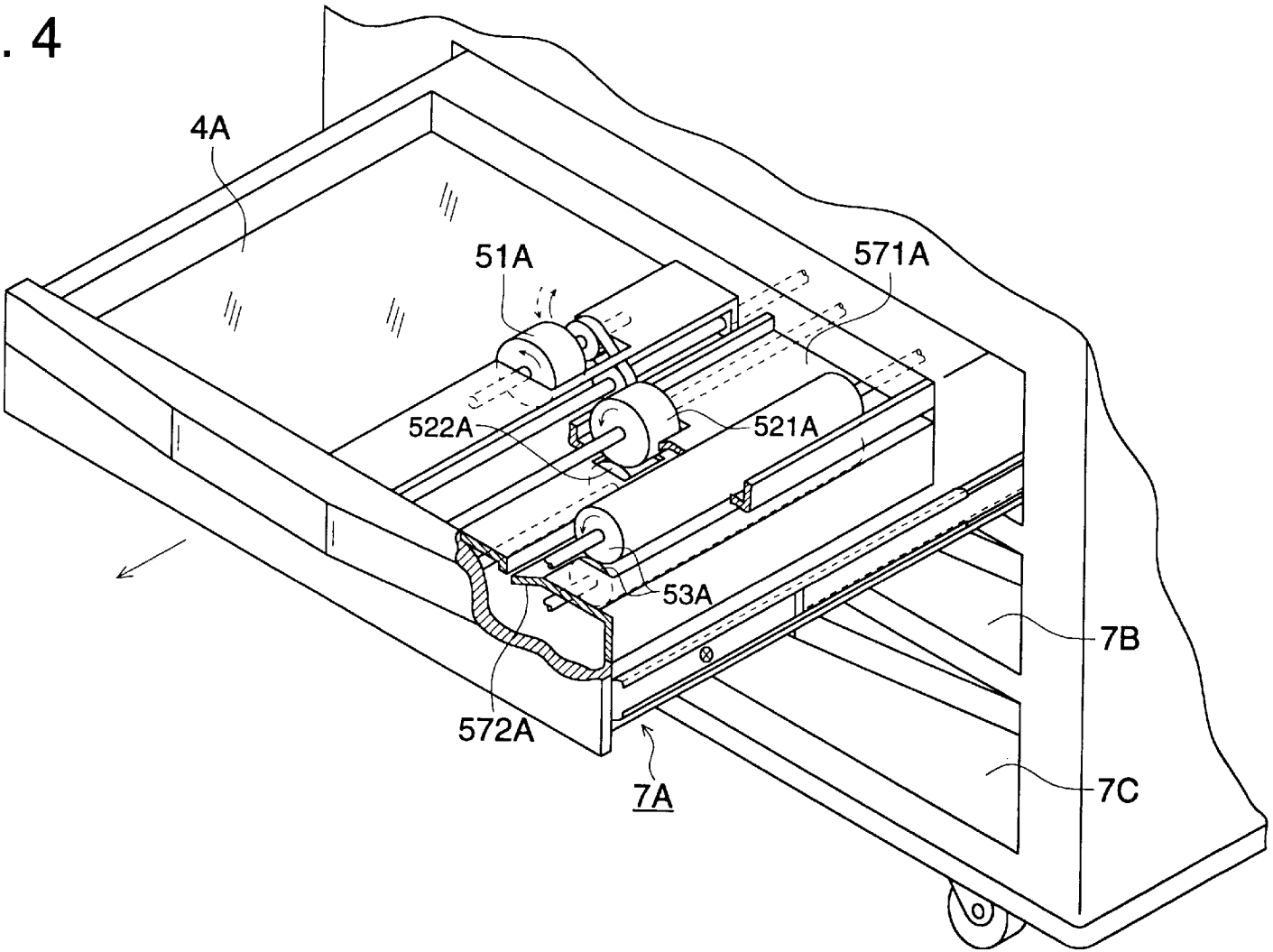
FIG. 4 is a perspective view wherein the first unit is drawn out.

In the present embodiment, even after the leading edge of the recording sheet hits the pre-registration roller 53, the separation means 52 still continues conveying the recording sheet, and thereby, the recording sheet whose leading edge is stopped forms a loop, and skewing of the sheet can be corrected. Incidentally, as shown in FIG. 4, in the present embodiment, the pre-registration roller has a width (length in the direction perpendicular to the conveyance direction for the recording sheet) preferably corresponding to a the width of the image-formable maximum size among recording sheets in the fixed form. This width is preferably width greater than that of pickup roller 51, fanning conveyance roller 521 and fanning retarding roller 522 provided at the central portion in the direction perpendicular to the conveyance direction for a recording sheet, whereby it is possible to correct skewing surely and to control dispersion in conveyance.

Further, in the present embodiment, upper guide 571 and lower guide 572 are provided between separation means 52 and pre-registration roller 53 as a guide member for guiding conveyance of a recording sheet, so that the loop may be formed surely. In the present embodiment, lower guide 572 is constituted to form an inversed angle in a sectional view (when viewed as in FIGS. 1 and 2). Incidentally, the lower guide 572 is divided on its half way, and is composed of two members. A loop form along the lower guide 572 is made to function as a loop forming guide which guides a recording sheet. It is preferable to provide this loop forming guide as a skewing-correcting means.

As stated above, in the present embodiment, the leading edge of a recording sheet hits pre-registration roller 53 which is not rotating and conveyance of the recording sheet by separation means 52 is continued, thereby, the recording sheet forms a loop so that skewing of the sheet may surely be corrected.

In the present embodiment, the pre-registration roller 53 is structured to serve as the first stopper means which is hit by a recording sheet and as a part of the first skewing correction means for correcting skewing of a recording sheet, so that the number of parts may be reduced. However, each function may also be separated to be provided. In this case, when the function is to be hit by a recording sheet only, it is not necessary to use paired rollers, and a shutter or a stopper which can block the conveyance path, for example, can be made to be the first stopper means.

Figure 3:
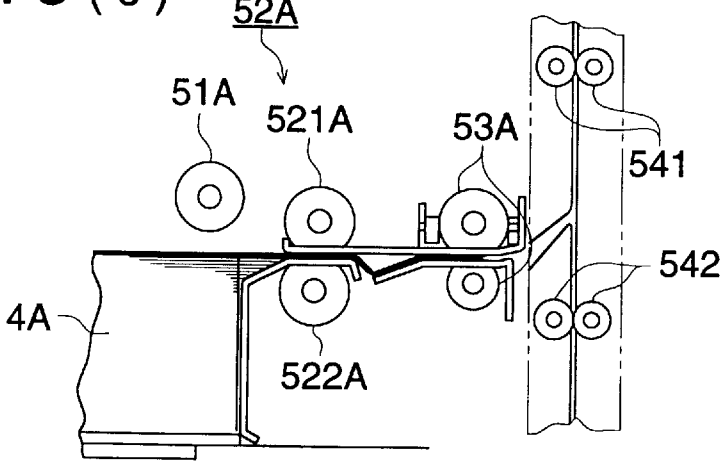
FIGS. 3(*a*) to 3(*d*) are illustrations, in the first embodiment, which illustrates operations in the vicinity of a recording sheet housing means.
Figure 3:
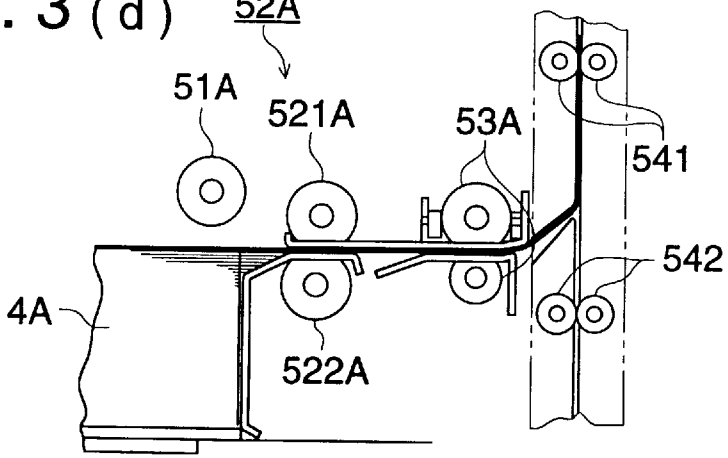
Figure 3:
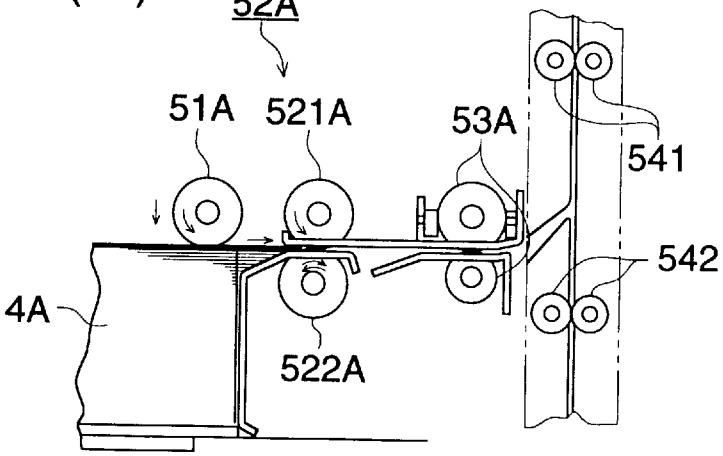
Figure 3:
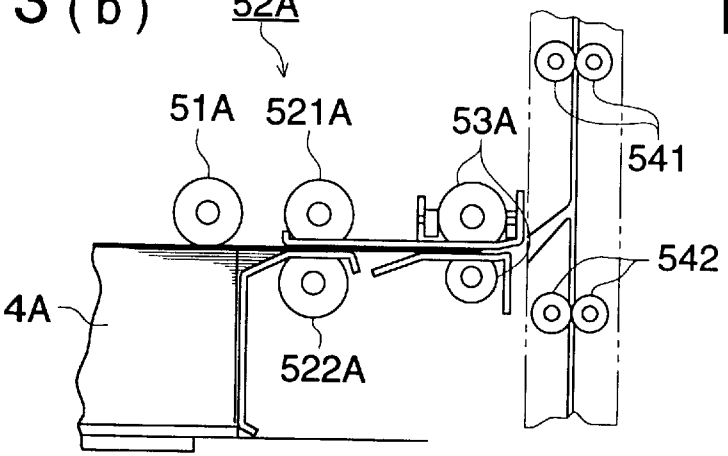

Incidentally, in the present embodiment, recording sheet housing means 4, pickup roller 51, separation means 52, pre-registration roller 53 and upper and lower guides 571 and 572 are unitized as unit 7 as shown in FIG. 3. Namely, this unit 7 is provided to be capable of being drawn out solidly through the front side of a copying machine. Therefore, when recording sheets housed in recording sheet housing means 4 are used up, the recording sheets can be replenished by drawing out the unit 7. When the recording sheet housing means 4 only is provided to be capable of being drawn out because sheet jamming tends to be caused in the vicinity of feeding-out and separation when various types of recording sheets are used, the jammed sheet is kept to be nipped between rollers, and jam clearance is complicated in feeding out. However, by unitizing as in the present embodiment, it is possible to feed out while the sheet is nipped by rollers, and jam clearance can be carried out easily and surely.

Incidentally, pickup roller 51, separation means 52 comprising fanning conveyance roller 521 and fanning retarding roller 522, pre-registration roller 53 and upper and lower guides 571 and 572 each having the same function are provided to correspond respectively to recording sheet housing means 4A–4C. Therefore, unit 7 is provided to respond respectively to each of recording sheet housing means 4A–4C (provided as first unit 7A–third unit 7C as shown in the drawing), and each of the first unit 7A–the third unit 7C is provided to be capable of being drawn out of a copying machine independently.

Intermediate conveyance rollers 541–543 represent an intermediate conveyance roller which conveys the recording sheet conveyed by pre-registration roller 53. These intermediate conveyance rollers 541–543 are provided on intermediate conveyance path b, and in the present embodiment, each of them is composed of paired rollers facing to each other and is rotated in the arrowed direction by an unillustrated driving means. Intermediate conveyance roller 541 is a roller which conveys the recording sheet conveyed by pre-registration rollers 53A–53C, namely, conveys the recording sheet from the first recording sheet housing means 4A–the third recording sheet housing means 4C. Intermediate conveyance roller 542 is a roller which conveys the recording sheet conveyed by pre-registration rollers 53B and 53C, namely, conveys the recording sheet from the second recording sheet housing means 4B and the third recording sheet housing means 4C. Intermediate conveyance roller 543 is a roller which conveys the recording sheet conveyed by pre-registration rollers 53C, namely, conveys the recording sheet from the third recording sheet housing means 4C.

Loop forming roller 55 is a means which conveys the recording sheet conveyed by intermediate conveyance roller 541. This loop forming roller 55 is composed of paired rollers facing to each other, and is provided on the second conveyance path c to be capable of being rotated in the arrowed direction by an unillustrated driving means. Incidentally, the loop forming roller 55 serves also as second loop forming means which constitutes the second skewing correction means for correcting skewing of a recording sheet.

Registration roller 56 is a second stopper means which is hit temporarily by the recording sheet conveyed by loop forming roller 55 and then starts conveying the recording sheet again. This registration roller 56 is composed of paired rollers facing to each other, and is provided on the second conveyance path c to be capable of being rotated in the arrowed direction by an unillustrated driving means. The registration roller 56 is not rotating when the recording sheet is conveyed by loop forming roller 55 to the registration roller 56, and is hit temporarily by the recording sheet whose leading edge is stopped accordingly. After that, the registration roller 56 is started to rotate, and the recording sheet is conveyed again by the registration roller 56. Then, laser writing system 33 is started to form a latent image in synchronization with the recording sheet fed out of the registration roller 56, whereby the recording sheet is synchronized with a toner image on photoreceptor drum 31. By making the recording sheet to hit temporarily the registration roller 56 as stated above, the timing of the leading edge of the recording sheet is made to be accurate, dispersion of conveyance can be controlled, and laser writing system 33 can easily be synchronized, thus, an image can be formed at an accurate position on the recording sheet.

In the present embodiment, even after the leading edge of the recording sheet hits the registration roller 56, the loop forming roller 55 still continues conveying the recording sheet, and thereby, the recording sheet whose leading edge is stopped forms a loop, and skewing of the sheet can be corrected. Further, in the present embodiment, upper guide 581 and lower guide 582 are provided between loop forming roller 55 and registration roller 56 as a guide member for guiding conveyance of a recording sheet, so that the loop may be formed surely. In the present embodiment, upper guide 581 is constituted to form an angle in a sectional view (when viewed as in FIGS. 1 and 2), and a loop form along the upper guide 581 is made to function as a loop forming guide which guides a recording sheet.

In the present embodiment, the registration roller 56 is structured to serve as the second stopper means which is hit by a recording sheet and as a part of the second skewing correction means for correcting skewing of a recording sheet, so that the number of parts may be reduced. However, each function may also be separated to be provided. In this case, when the function is to be hit by a recording sheet only, it is not necessary to structure with paired rollers, and a shutter or a stopper which can block the conveyance path, for example, can be made to be the second stopper means.

A recording sheet housed in the first recording sheet housing means 4A is conveyed by conveyance means 5 having the aforesaid structure (means) to image forming means 3, through pickup roller 51A, separation means 52A, pre-registration roller 53A, intermediate conveyance roller 541, loop forming roller 55 and registration roller 56. In the same way, a recording sheet housed in the second recording sheet housing means 4B is conveyed to image forming means 3, through pickup roller 51B, separation means 52B, pre-registration roller 53B, intermediate conveyance rollers 542 and 541, loop forming roller 55 and registration roller 56, and a recording sheet housed in the third recording sheet housing means 4C is conveyed to image forming means 3, through pickup roller 51C, separation means 52C, pre-registration roller 53C, intermediate conveyance rollers 543, 542 and 541, loop forming roller 55 and registration roller 56.

(First Embodiment with Regard to Conveying Operaton)

Now, a conveying operation for a recording sheet by the conveying means 5 will be explained with reference to FIGS. 2 and 3. As stated above, since the same conveying operation is conducted for a recording sheet accommodated in any recording sheet housing means 4A to 4C, here the conveyance for a recording sheet stored in the first recording sheet housing means 4A is explained.

When signals to start feeding a sheet are received from an unillustrated control means, pickup roller 51A is moved to the lower position first, and then, the pickup roller 51A and fanning conveyance roller 521 are rotated in the arrowed direction in FIG. 3(*a*). Due to this, the uppermost recording sheet (shown with thick lines in FIG. 3) among plural recording sheets housed in the first recording sheet housing means 4A is fed out, and then is separated one by one by separation means 52A (fanning conveyance roller 521A and fanning retarding roller 522A) to be conveyed. Then, the recording sheet thus separated and conveyed by the separation means 52A hits pre-registration roller 53A which is not rotating (FIG. 3(*b*)). Incidentally, when the recording sheet is conveyed by the separation means 52A, the pickup roller 51A is moved to the upper position.

Even after the recording sheet hits pre-registration roller 53A, conveyance of the recording sheet by separation means 52A is continued. Therefore, a loop of the recording sheet whose leading edge is stopped by the pre-registration roller 53A is formed by further conveyance by the separation means 52A between the pre-registration roller 53A and the separation means 52A as shown in FIG. 3(*c*), by further conveyance of the recording sheet by the separation means 52A. In this case, a loop is formed surely to be in an appropriate form by upper and lower guides 571 and 572, and it is possible to form a sufficient loop and thereby to correct sheet skewing for certain. In particular, in recent years wherein various types of recording sheets including an ordinary sheet and a recycled sheet are used, the moment of sheet feeding (feeding out and separation) from recording sheet housing means 4 is most unstable for occurrence of sheet skewing because of slip between a recording sheet and a roller. However, the skewing can be corrected at the initial stage, and bad influence on the later stage can be eliminated. Further, in the present embodiment, sheet skewing is corrected at this side (upstream side in the conveyance direction) of the position of the curve where the conveyance direction is changed from the first conveyance path a to the intermediate conveyance path b. Therefore, occurrence of sheet skewing caused by the curve can be reduced to the minimum, which leads to prevention of occurrence of sheet jamming.

Though feeding out of a recording sheet from the first recording sheet housing means 4A, separation of the recording sheet and loop formation are arranged to be conducted at prescribed intervals, this does not apply when there is a preceding recording sheet, and when a recording sheet is conveyed by pre-registration roller 53A. However, when a recording sheet to be conveyed through feeding out, separation and loop formation will not overlap with a preceding recording sheet, that recording sheet may be fed out.

After an appropriate loop is formed on the recording sheet, conveyance thereof by separation means 52A is stopped, and pre-registration roller 53A, intermediate conveyance roller 541 and loop forming roller 55 are started to rotate, based on signals to restart pre-registration by the control means. Therefore, the recording sheet which hits pre-registration roller 52A and is stopped is conveyed at the accurate timing, together with the start of rotation based on the signals to restart driving a pre-registration roller. In particular, in spite of the sheet feeding from recording sheet housing means 4 which is in the most unstable state in terms of dispersion of conveyance timing for the same reason stated above, accurate timing is secured, and that timing can be conducted at the initial stage, thus, influence on the later stage can be eliminated. In this case, fanning conveyance roller 521 is rotated by the recording sheet conveyed by pre-registration roller 53A, and on the other hand, fanning retarding roller 522 is operating, through an action of a torque limiter, so that a recording sheet other than the recording sheet to be conveyed will not be conveyed.

The foregoing does not apply, in this case, when there is a preceding recording sheet and when the preceding recording sheet is conveyed by loop forming roller 55 or by intermediate conveyance roller 541. However, when a recording sheet to be restarted from pre-registration roller 53A will not overlap with the preceding recording sheet, reconveyance can be started.

Then, the recording sheet conveyed by pre-registration roller 53A is conveyed by intermediate conveyance roller 541 located on intermediate conveyance path b (FIG. 3(*d*)), and is further conveyed by loop forming roller 55. The recording sheet conveyed by the loop forming roller 55 hits registration roller 56 which is not rotating. Even after the registration roller 56 is hit by the recording sheet, conveyance of the recording sheet by the loop forming roller 55 is continued. Therefore, the recording sheet whose leading edge is stopped by the registration roller 56 is further conveyed by loop forming roller 55, and a loop is formed between the registration roller 56 and the loop forming roller 55, in the same way in FIG. 3(*c*). In this case, a loop is formed surely to be in an appropriate form by upper and lower guides 581 and 582, and it is possible to form a sufficient loop and thereby to correct surely sheet skewing caused by conveyance between the pre-registration roller 53A and the registration roller 56.

After an appropriate loop is formed on the recording sheet, conveyance by the loop forming roller 55 is stopped, and rotation of the registration roller 56 is started based on signals to restart registration by the control means. The peripheral speed of rotation of the registration roller 56 is the same as the process speed at which the image formation is conducted by image forming means 3. Therefore, the recording sheet which hits the registration roller 56 and is stopped is conveyed at the accurate timing simultaneously with the start of rotation based on signals to restart registration. In this case, the loop forming roller 55 is driven to rotate in synchronization with the registration roller 56.

(Second Embodiment with Regard to Conveying Operaton)

In the present embodiment, an automatic control is conducted to change the timing of the start and stopping of driving and to change the conveyance speed by using a detecting means. For this purpose, in the present embodiment, there is provided an independent driving means (motor) in each of various driving means such as a driving means (provided to correspond respectively to each of recording sheet housing means 4A–4C, or provided to be capable of driving independently through clutches and gears) which drives a feed-out means (actually, pickup roller 51 and fanning conveyance roller 521), a driving means which drives pre-registration roller 53, a driving means which drives intermediate rollers 541–543, and a driving means which drives loop forming roller 55. However, each of them can be provided to be capable of driving independently through clutches and gears. Due to this, its control of driving can be made easy.

Figure 5:
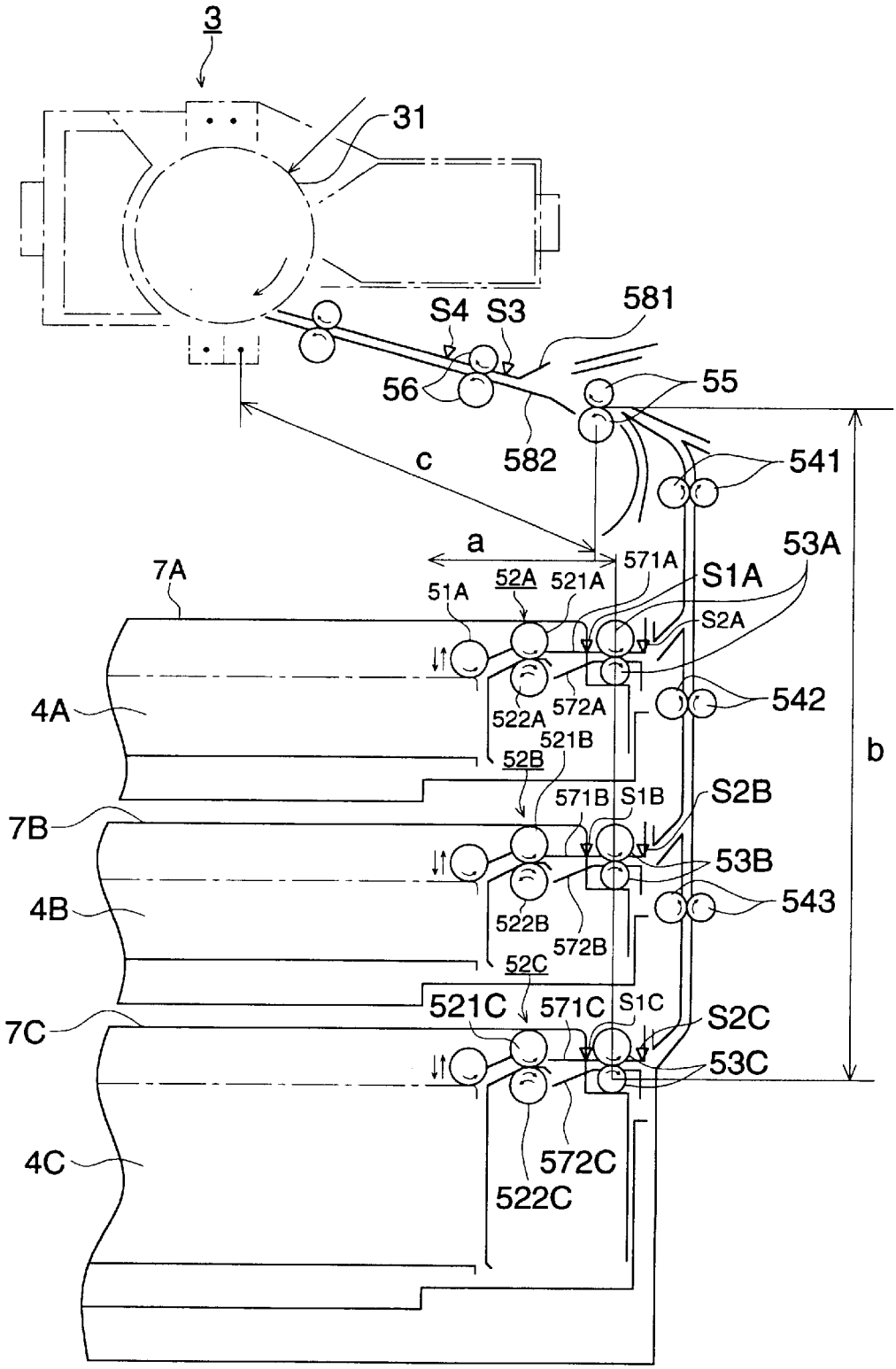
FIG. 5 is a diagram, in the second embodiment, wherein a conveyance path through which a recording sheet is conveyed by a conveyance means is enlarged illustratively.

Next, sensors used as the detecting means will be explained with reference to FIG. 5. Sensors relating to conveyance of a recording sheet include first sensors S1A–S1C representing the first detection means which detects the leading edge of the recording sheet which is being conveyed, second sensors S2A–S2C representing the second detection means which detects the trailing edge of the recording sheet which is being conveyed, third sensor S3 representing the third detection means which detects the leading edge of the recording sheet which is being conveyed, and fourth sensor S4 representing the fourth detection means which detects the leading edge and the trailing edge of the recording sheet which is being conveyed. The first sensor S1 and the second sensor S2 are provided to detect the recording sheet on the first conveyance path, corresponding respectively to each of recording sheet housing means 4A–4C. The third sensor S3 and the fourth sensor S4 are sensors to be used in common by any recording sheet independently of the recording sheet housing means from which the recording sheet is conveyed, and they are provided to detect the recording sheet on the second conveyance path. Various kinds of sensors such as a photosensor and a microswitch can be used as the sensors S1–S4.

The first sensor S1 is a detection means which detects the leading edge of the recording sheet conveyed by separation means 52. Conveyance of the recording sheet by the separation means 52 (which is fanning conveyance roller 521 concretely, and pickup roller 51 is also included in addition to the separation means 52 in the present embodiment) is stopped based on the results of detection by the first sensor S1. Namely, when the leading edge of the recording sheet is detected by the first sensor S1, conveyance of the recording sheet by separation means 52 is stopped after the lapse of prescribed time (t1 sec). This prescribed time (t1 sec) is sufficient to form a loop, and it is a period of time which is established so that the conveyance of the recording sheet by separation means 52 is continued for t2 sec after the leading edge of the recording sheet conveyed by separation means 52 hits pre-registration roller 53 which is not rotating, and then the conveyance by the separation means 52 is stopped (see FIGS. 9 and 10).

In the present embodiment, the first sensor S1 is arranged between separation means 52 and pre-registration roller 53, and it is structured so that a loop may be formed more accurately by detecting the leading edge of the recording sheet coming out of the separation means 52, which is preferable. The first sensor S1 has only to be located at the upstream side of pre-registration roller 53 in the conveyance direction for a recording sheet.

The second sensor S2 is a detection means which detects the trailing edge of the recording sheet conveyed (reconveyed) by pre-registration roller 53. Driving of the pre-registration roller 53 is stopped based on the results of detection by the second sensor S2. Namely, when the trailing edge of the recording sheet is detected by the second sensor S2, the trailing edge of the recording sheet is out of the pre-registration roller 53, and therefore, rotation of the pre-registration roller 53 is stopped so that the following recording sheet (succeeding recording sheet) may hit the pre-registration roller 53. Further, a conveyance means starts conveying the succeeding recording sheet based on the results of detection by the second sensor S2 (actually, the start of rotation of pickup roller 51 and fanning conveyance roller 521). Namely, when the trailing edge of the preceding recording sheet is detected by the second sensor S2, feeding out of the recording sheet by pickup roller 51 is started after prescribed time (t3 sec), and separation by separation means 52 is conducted (see FIGS. 9 and 10). By starting feeding out of the following recording sheet immediately after the preceding sheet passes over the pre-registration roller, a spare time to absorb irregularities in feeding out becomes longer. In other words, the irregularities in feeding out can be absorbed by a waiting time of the pre-registration roller.

Incidentally, in the present embodiment, the second sensor S2 is arranged at the downstream side of pre-registration roller 53 in the conveyance direction for a recording sheet (in detail, arranged between pre-registration roller 53 and a conveyance means (concretely, intermediate conveyance rollers 541–543) adjoining the pre-registration roller 53 at the downstream side thereof in the conveyance direction for a recording sheet, and detection of the trailing edge of the recording sheet reconveyed from the pre-registration roller 53 makes the feeding out of the succeeding recording sheet to be started earlier, which is preferable. The second sensor S2 has only to be located at the downstream side of pre-registration roller 53 in the conveyance direction for a recording sheet. In the present embodiment, the second sensor S2 detects the trailing edge of the recording sheet, which is preferable because it is possible to control the timing accurately. However, it is also possible to arrange so that the leading edge of the recording sheet reconveyed from the pre-registration roller 53 may be detected by the second sensor S2. In this case, the control stated above, namely stoppage of rotation of pre-registration roller 53 conducted after the trailing edge of the recording sheet has got out of the pre-registration roller 53 and the start of the conveyance of the succeeding recording sheet by a feed-out means (pickup roller 51A and separation means 52A) are conducted based on the results of detection by the second sensor S2 which detects the leading edge and on the length of the recording sheet.

The third sensor S3 is a detection means which detects the leading edge of the recording sheet which is being conveyed by loop forming roller 55. Based on the results of detection by the third sensor S3, the loop forming roller 55 stops conveying the recording sheet (in detail, intermediate conveyance rollers 541–543 also stop conveying the recording sheet). Namely, when the leading edge of the recording sheet is detected by the third sensor S3, loop forming roller 55 stops conveying the recording sheet after the lapse of prescribed time (t4 sec). This prescribed time (t4 sec) is sufficient to form a loop, and it is a period of time which is established so that the conveyance of the recording sheet by loop forming roller 55 is continued for t5 sec after the leading edge of the recording sheet conveyed by loop forming roller 55 hits registration roller 56 which is not rotating, and then the conveyance by the loop forming roller 55 is stopped. (see FIGS. 9 and 10)

In the present embodiment, the third sensor S3 is arranged between loop forming roller 55 and registration roller 56, and it is possible to form a loop more accurately by detecting the leading edge of the recording sheet which has got out of the loop forming roller 55, which is preferable, but the third sensor S3 has only to be arranged at the upstream side of the registration roller 56 in the direction of conveyance for a recording sheet. Further, though the third sensor S3 is provided at the downstream side of the loop forming roller 55 in the direction of conveyance for a recording sheet in the present embodiment, it can also be provided at the upstream side of the loop forming roller 55 in the direction of conveyance for a recording sheet. In this case, it is also possible to arrange to detect the trailing edge of the recording sheet reconveyed from pre-registration roller 53 without detecting the leading edge of the recording sheet, so that it may be used for the control stated above. In this case, however, the third sensor S3 needs to be arranged at the position wherein the leading edge of the recording sheet has not reached the registration roller 56 when the trailing edge of the recording sheet is detected by the third sensor S3.

The fourth sensor S4 is a detection means which detects the leading edge of the recording sheet conveyed (reconveyed) by registration roller 56. Based on the results of detection by the fourth sensor S4, there is started the conveyance of the succeeding recording sheet by the conveyance means (pre-registration roller 53 and intermediate conveyance rollers 541 543, in the present embodiment)

arranged at the upstream side of loop forming roller 55 in the direction of conveyance for a recording sheet. Namely, when the leading edge of the recording sheet is detected by the fourth sensor S4, the conveyance of the recording sheet stopped momentarily by pre-registration roller 53 is started again after the lapse of prescribed time (t6 sec). This prescribed time (t6 sec) is a period of time which makes the leading edge of the succeeding recording sheet reconveyed by pre-registration roller 53 not to catch up with the trailing edge of the preceding recording sheet reconveyed by registration roller 56. (see FIGS. 9 and 10)

The fourth sensor S4 also is a detection means which detects the trailing edge of the recording sheet conveyed (reconveyed) by registration roller 56. Based on the results of its detection, there is started the conveyance of the succeeding recording sheet by registration roller 56. Namely, when the trailing edge of the recording sheet is detected by the fourth sensor S4, the conveyance of the recording sheet stopped momentarily by registration roller 56 is started again after the lapse of prescribed time (t7 sec). This prescribed time (t7 sec) is one to adjust an interval between the leading edge of the succeeding recording sheet reconveyed by registration roller 56 and the trailing edge of the preceding recording sheet conveyed earlier (namely, space between recording sheets in image forming), and it may be established properly in accordance with a size of a recording sheet.

In the present embodiment, the fourth sensor S4 is arranged at the downstream side of registration roller 56 in the direction of conveyance for a recording sheet, and it detects the leading edge and the trailing edge of the recording sheet conveyed from the registration roller 56, so that the recording sheet may be conveyed more accurately. Incidentally, in the present embodiment, restarting (reconveyance) of the succeeding recording sheet by registration roller 56 is conducted after the lapse of prescribed time (t7 sec), in terms of timing, from the detection of the trailing edge of the preceding recording sheet by the fourth sensor S4. However, it is also possible to conduct the restarting (reconveyance) of the succeeding recording sheet by registration roller 56 after the lapse of prescribed time (>t7 sec) from the detection of the leading edge of the preceding recording sheet reconveyed.

Figure 6:
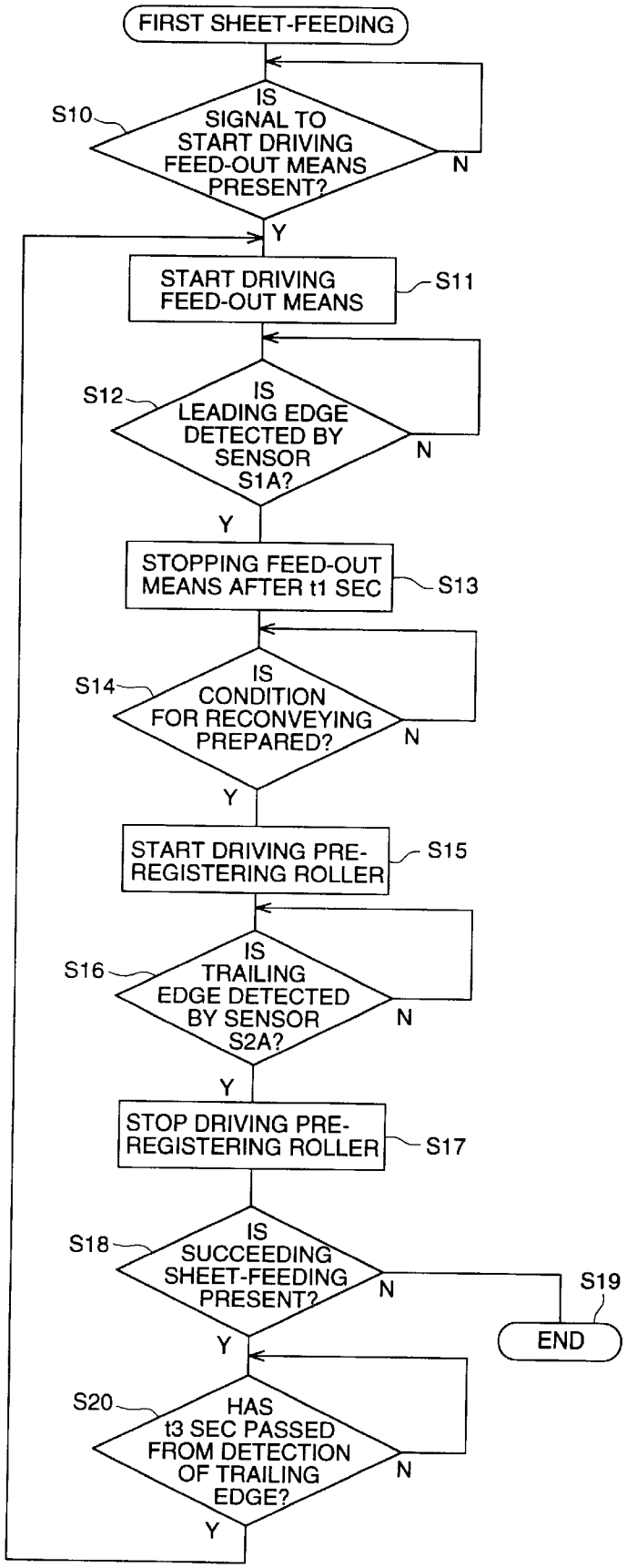
FIG. 6 is a flow chart relating to the first sheet feeding.
Figure 8:
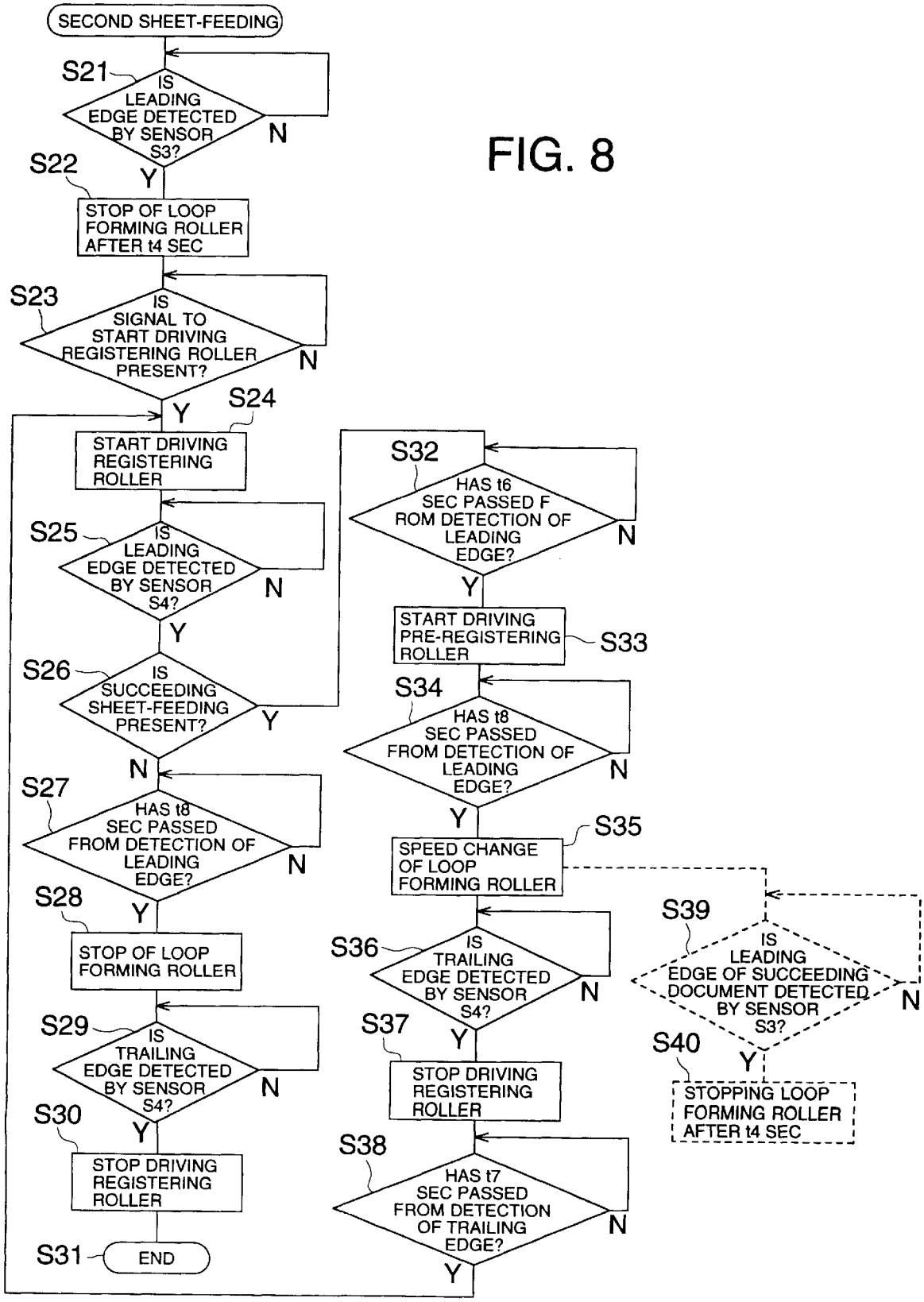
FIG. 8 is a flow chart relating to the second sheet feeding.
Figure 9:
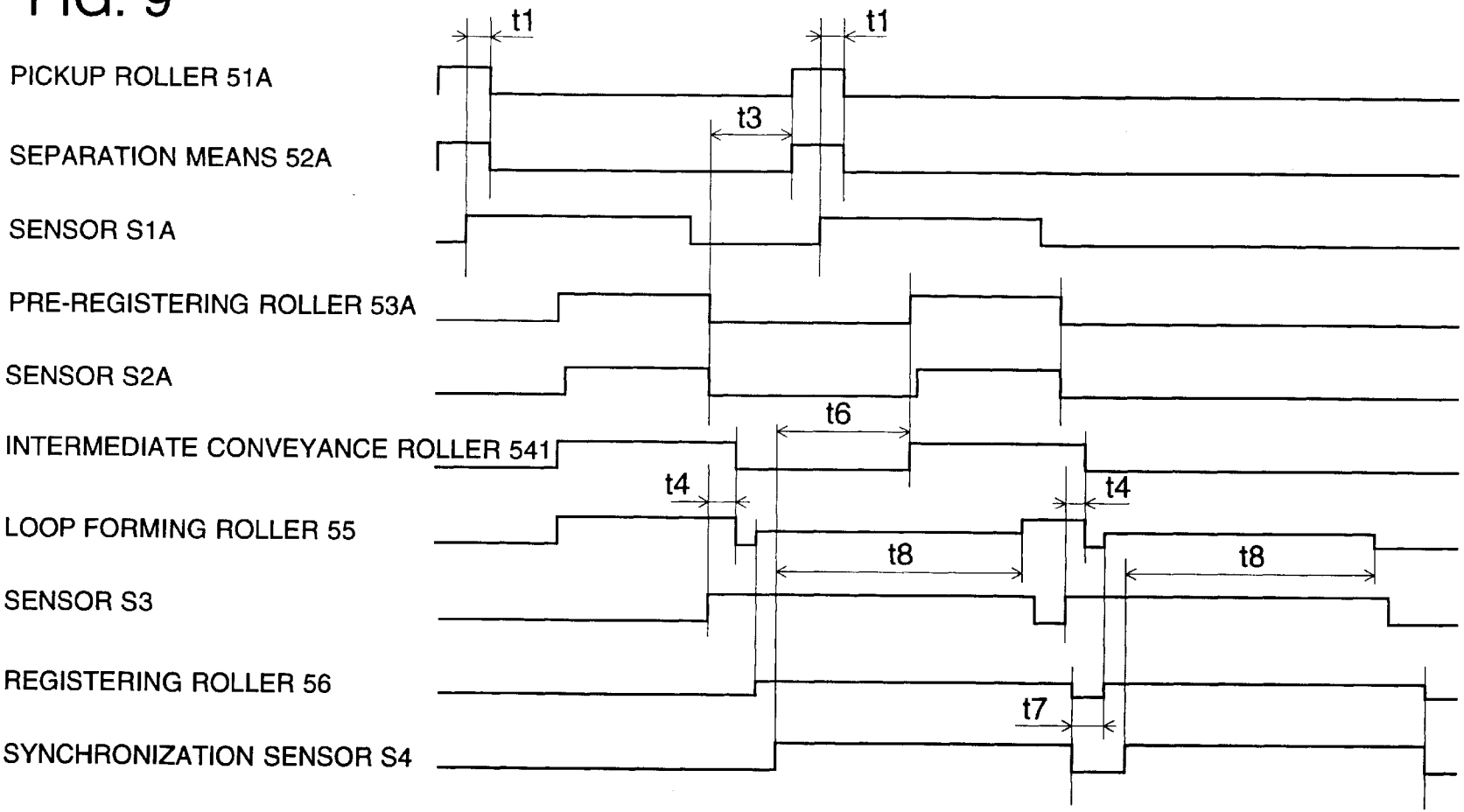
FIG. 9 is a timing chart for each roller and sensor.
Figure 10:
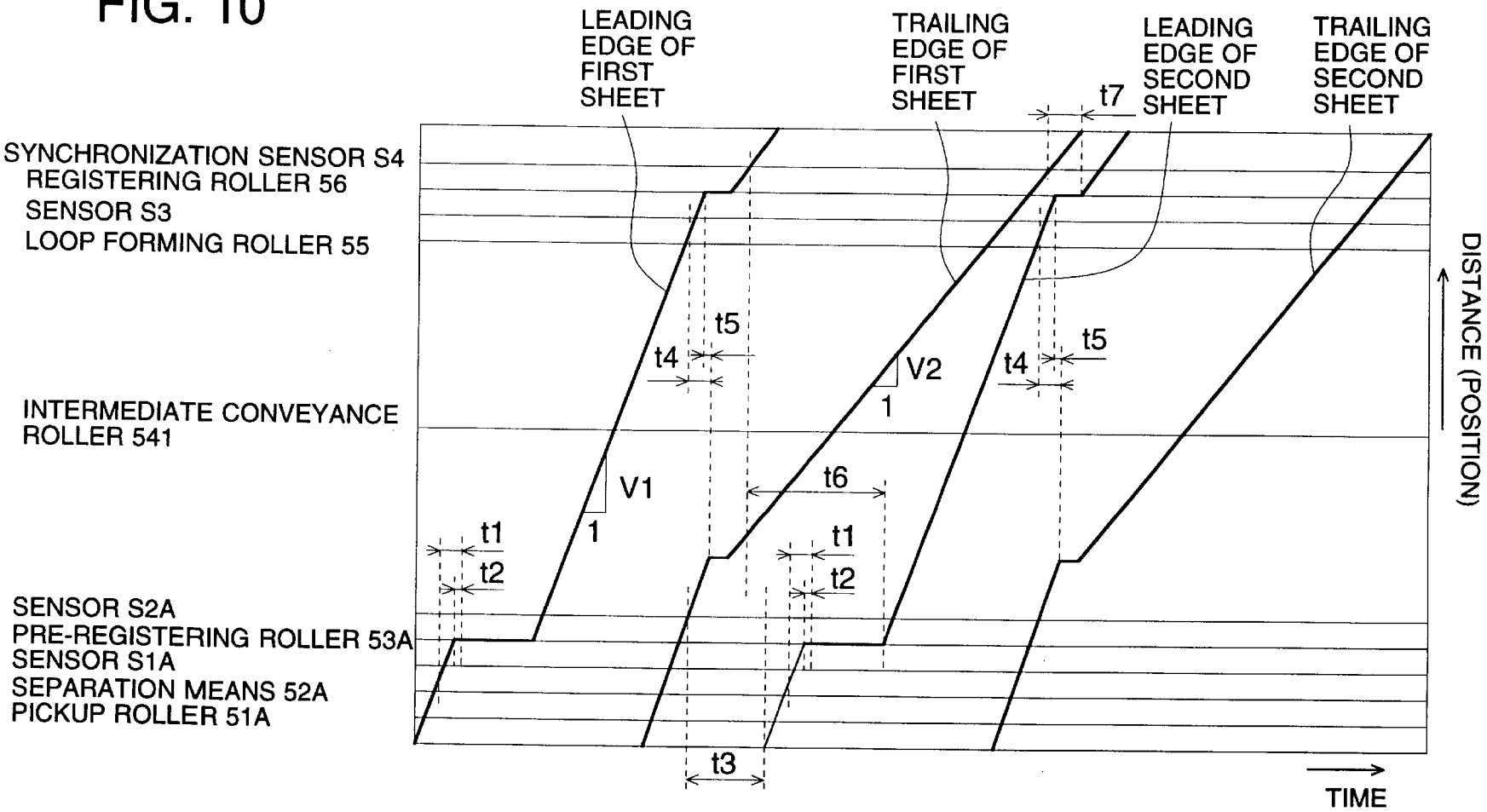
FIG. 10 is a timing chart showing the position of a recording sheet illustratively.

Next, operations of conveyance means 5 to convey a recording sheet will be explained based on FIG. 5 and FIGS. 6–10. FIG. 6 is a flow chart relating to the first sheet feeding covering from pickup roller 51 to pre-registration roller 53. FIG. 7 is an illustration for explaining operations in the vicinity of a recording sheet housing means. FIG. 8 is a flow chart relating to the second sheet feeding in the vicinity of registration roller 56. FIG. 9 is a diagram of timing chart indicating driving of rollers (51–56) and detection by sensors (S1–S4). FIG. 10 is a diagram of timing chart showing illustratively the positions of recording sheets.

Conveyance of the recording sheet housed in the first recording sheet housing means 4A will be explained here, because the same conveyance is conducted on any recording sheet housed in any of recording sheet housing means 4A–4C as stated above. First, the conveyance of one recording sheet from the first recording sheet housing means 4A will be explained, and after that, the conveyance of plural recording sheets (two sheets in this case) will be explained.

When signals to start feed-out means (pickup roller 51A and separation means 52) representing signals to start sheet feeding are received from an unillustrated control means (S10), pickup roller 51A is moved to the lower position first so that it may touch the uppermost position of recording sheets housed in the recording sheet housing means 4A, and then, pickup roller 51A and fanning conveyance roller 521A are started to rotate (driving) in the arrowed direction in FIG. 7(*a*) (S11). The peripheral speed for rotation of pickup roller 51A and fanning conveyance roller 521 in this case is V1 which is faster than process speed Vp (V1>Vp). Due to this, the recording sheet (shown with thick lines in FIG. 7) which is uppermost among plural recording sheets housed in the first recording sheet housing means 4A is fed out by pickup roller 51A, then, separated one by one by separation means 52A (fanning conveyance roller 521A and fanning retarding roller 522A), and conveyed at speed V1.

Though the peripheral speed for rotation of pickup roller 51A and fanning conveyance roller 521 is represented by V1 which is higher than process speed Vp in the present embodiment, the invention is not limited to this. For example, it is possible to drive the feed-out means to convey at the speed which is lower than the conveyance speed (speed V1) for the recording sheet reconveyed from pre-registration roller 53A as will be described later, in other words, it is possible to achieve improvement of separation efficiency by separating the recording sheet at the low speed.

With regard to the recording sheet separated and conveyed by separation means 52A, the leading edge of the recording sheet is detected by the first sensor S1A (S12), and it hits pre-registration roller 53A which is not rotating (FIG. 7(*b*)). On the other hand, after the lapse of prescribed time (t1 sec) from the moment when the leading edge of the recording sheet is detected by the first sensor S1A, the driving of the feed-out means (pickup roller 51A and fanning conveyance roller 521A) is stopped (S13).

Stopping the driving of the feed-out means after the lapse of prescribed time (t1 sec) means that conveyance of the recording sheet by separation means 52A is continued for t2 sec after pre-registration roller 53A is hit by the leading edge of the recording sheet, and then, the conveyance of the recording sheet is stopped, as stated above. Therefore, after the pre-registration roller 53A is hit by the recording sheet and at least the leading edge of the recording sheet is stopped, the conveyance by separation means 52A is stopped, which makes the recording sheet to form an appropriate loop. In other words, the recording sheet whose leading edge is stopped by the pre-registration roller 53A is further conveyed by separation means 52A, and thereby, a loop is formed between the pre-registration roller 53A and separation means 52A as shown in FIG. 7(*c*).

In this case, a loop in a proper shape is formed surely by upper and lower guides 571 and 572, and the loop is sufficient in quantity, whereby, sheet skewing can be corrected for certain. In particular, in recent years wherein various types of recording sheets including an ordinary sheet and a recycled sheet are used, the moment of sheet feeding (feeding out and separation) from recording sheet housing means 4 is most unstable for occurrence of sheet skewing because of slip between a recording sheet and a roller. However, the skewing can be corrected at the initial stage, and bad influence on the later stage can be eliminated. Further, in the present embodiment, sheet skewing is corrected at this side (upstream side in the conveyance direction) of the position of the curve where the conveyance direction is changed from the first conveyance path a to the intermediate conveyance path b. Therefore, occurrence of sheet skewing caused by the curve can be reduced to the minimum, which leads to prevention of occurrence of sheet jamming.

Incidentally, in the present embodiment, pickup roller 51A is moved to the upper position (position to be away from the recording sheet) after the driving of the feed-out means is stopped (S13). However, from the viewpoint of prevention of double feeding, pickup roller 51A may be moved to the upper position after the recording sheet is conveyed by separation means 52A (for example, after the leading edge of the recording sheet is detected by the first sensor S1A).

After an appropriate loop is formed on the recording sheet by pre-registration roller 53 and separation means 52, and stopped, a control means judges whether the reconveyance condition is prepared or not (S14), and if the reconveyance condition is prepared (in this case, the reconveyance condition is prepared if prescribed time passes after the stop of separation means 52, because conveyance of one sheet is explained), the rotation of pre-registration roller 53 is started (S15) based on signals from the control means to start driving a pre-registration roller, and simultaneously with this, intermediate conveyance roller 541 and loop forming roller 55 are started to rotate. Therefore, the recording sheet which hits pre-registration roller 53A and is stopped is reconveyed at the accurate timing, together with the start of rotation based on the signals to start driving a pre-registration roller. In particular, in spite of the sheet feeding from recording sheet housing means 4 which is in the most unstable state in terms of dispersion of conveyance timing for the same reason stated above, accurate timing is secured, and that timing can be conducted at the initial stage, thus, influence on the later stage can be eliminated. In this case, fanning conveyance roller 521 is rotated by the recording sheet conveyed by pre-registration roller 53A, and on the other hand, fanning retarding roller 522 is operating, through an action of a torque limiter, so that a recording sheet other than the recording sheet to be conveyed will not be conveyed.

In this case, the peripheral speed of pre-registration roller 53A, intermediate conveyance roller 541 and loop forming roller 55 is represented by V1 which is higher than process speed Vp (V1>Vp). Namely, the recording sheet whose reconveyance has been started is conveyed at the speed of V1 which is higher than process speed Vp, by pre-registration roller 53A, intermediate conveyance roller 541 and loop forming roller 55.

Then, when the trailing edge of the recording sheet reconveyed by pre-registration roller 53A passes through the pre-registration roller 53A and is detected by the second sensor S2A (S16), the driving of the pre-registration roller 53A is stopped (S17). Incidentally, since the present explanation is for conveyance of one sheet, the first sheet feeding is terminated (S19) because there is no recording sheet (succeeding recording sheet) to be fed next (NO in S18).

On the other hand, the recording sheet conveyed by the pre-registration roller 53A is conveyed by intermediate conveyance roller 541 on intermediate conveyance path b (FIG. 7(*d*)), and is further conveyed loop forming roller 55. The leading edge of the recording sheet conveyed by the loop forming roller 55 is detected by the third sensor S3 (S21), and it hits registration roller 56 which is not rotating. Then, after the lapse of prescribed time (t4 sec) from the moment when the leading edge of the recording sheet is detected by the third sensor S3, the driving for loop forming roller 55 and intermediate conveyance roller 541 is stopped (S22).

Namely, the stopping of the driving for loop forming roller 55 after the lapse of prescribed time (t4 sec) means that the recording sheet is stopped after continuation of conveyance of loop forming roller 55 for t5 sec after the leading edge of the recording sheet hits registration roller 56, as stated above. Therefore, when conveyance of the recording sheet by loop forming roller 55 is stopped after registration roller 56 is hit by the recording sheet and after at least the leading edge of the recording sheet is stopped, an appropriate loop is formed on the recording sheet. In other words, the recording sheet whose leading edge is stopped by registration roller 56 is further conveyed by loop forming roller 55 and forms a loop between registration roller 56 and loop forming roller 55.

In this case, a loop to be formed is surely formed to be in a proper shape by upper and lower guides 581 and 582, and a sufficient loop can be formed, thus, sheet skewing caused by conveyance between pre-registration roller 53A and registration roller 56 can be surely corrected. In particular, in the present embodiment, sheet skewing is corrected in this place in addition to the correction of skewing of the recording sheet at the upstream side, thus, it is possible to convey the recording sheet having less skewing to image forming means 3 for excellent image forming.

After the recording sheet forms thereon an appropriate loop together with registration roller 56 and loop forming roller 55 and is stopped, rotation of registration roller 56 is started (S24) based on signals to start driving a registration roller outputted by the control means (S23). In this case, the peripheral speed of rotation of registration roller 56 is represented by V2 which is the same as process speed Vp at which the image forming is conducted by image forming means 3 (V2<V1). Therefore, the recording sheet which has hit registration roller 56 and is stopped is conveyed at the speed of V2 at the accurate timing upon the start of rotation based on signals to start driving the registration roller. Thus, by reconveying the recording sheet stopped at pre-registration roller 53A, it is possible to convey to image forming means 3 at the accurate timing, and thereby to synchronize accurately with the image formation by image forming means 3 to conduct excellent image forming. In particular, in the present embodiment, deviation of timing of the recording sheet to reach registration roller 56 is less in spite of various types of recording materials because the recording sheet is reconveyed after hitting at the upstream side of this place, thus stable timing for conveyance can be secured and excellent image forming can be carried out. Incidentally, in this case, loop forming roller 55 is driven to rotate at the peripheral speed of V2 in synchronization with registration roller 56.

When the leading edge of the recording sheet reconveyed from registration roller 56 in S24 is detected by the fourth sensor S4 (S25), N appears in S26 because one recording sheet is conveyed in the present explanation and no recording sheet to be fed (succeeding recording sheet) is present, and the sequence advances to S27. Namely, after the lapse of prescribed time (t8 sec) (S27) from the moment when the leading edge of the recording sheet conveyed by registration roller 56 is detected by the fourth sensor S4 in S25, the rotation of loop forming roller 55 is stopped (S28). This prescribed time (t8 sec) is a period of time required for the trailing edge of the recording sheet to pass through loop forming roller 55 after the detection of the leading edge of the recording sheet by the fourth sensor S4, and the lapse of prescribed time (t8 sec) means that the recording sheet passes through loop forming roller 55 not to be nipped by loop forming roller 55 and not to be conveyed. Therefore, the driving of loop forming roller 55 is stopped after the lapse of prescribed time (t8 sec) from the moment when the fourth sensor S4 detects the leading edge of the recording sheet.

Even when the driving of loop forming roller 55 is stopped, conveyance of registration roller 56 is continued, and when the recording sheet passes through registration roller 55 and the trailing edge of the recording sheet is detected by the fourth sensor S4 (S29), the driving of registration roller 56 is stopped (S30), thus, the second sheet feeding is completed (S31) and sheet feeding operations for the recording sheet end.

Though operations for feeding one recording sheet from the first recording sheet housing means 4A have been described in the aforesaid explanation, there will be explained as follows the operations for continuous sheet feeding, namely operations for feeding plural recording sheets continuously, concretely, operations for feeding two recording sheets continuously. Incidentally, in the following explanation, operations for the first recording sheet (also called a preceding recording sheet) are the same as those described above, therefore, the second recording sheet (also called a succeeding recording sheet) will mainly be explained. Even if some operations belong to sheet feeding of the succeeding recording sheet, if these operations are the same as those for sheet feeding of the preceding recording sheet, the operations may sometimes be omitted.

Sheet feeding for the succeeding recording sheet is started (S20) after the lapse of prescribed time (t3 sec) from the moment when the trailing edge of the preceding recording sheet reconveyed (S15) by pre-registration roller 53A is detected by the second sensor S2A, after the preceding recording sheet is fed out of recording sheet housing means 4A (S11) by a feed-out means (pickup roller 51A and separation means 52A) to hit pre-registration roller 53A and thereby to form a loop (S13). By starting feeding out of the following recording sheet immediately after the preceding sheet passes over the pre-registration roller, a spare time to absorb irregularities in feeding out becomes longer. In other words, the irregularities in feeding out can be absorbed by a waiting time of the pre-registration roller. Further, sheet feeding for the succeeding recording sheet is started after the preceding recording sheet has passed through pre-registration roller 53A completely. It is therefore possible to feed out from recording sheet housing means 4A in a way wherein the preceding recording sheet and the succeeding recording sheet are not overlapped. Further, it is possible to detect surely that the preceding recording sheet has passed through pre-registration roller 53A, because the second sensor S2A is provided at the downstream side of pre-registration roller 53A in the conveyance direction for a recording sheet.

The succeeding recording sheet whose sheet feeding has been started as described above is fed out of recording sheet housing mean 4A (S11) by feed-out means (pickup roller 51A and separation means 52A) through 911–S13 in the same way as in the foregoing, Then, when the feed-out means is stopped (S13) after t1 sec based on information of the leading edge of the succeeding recording sheet detected (S12) by the first sensor S1A, the succeeding recording sheet hits pre-registration roller 53A and stops after a loop is formed. Incidentally, the speed with which the succeeding recording sheet is conveyed by a feed-out means (pickup roller 51A and separation means 52A) is the same as that in the foregoing.

When conditions for reconveyance are prepared (S14), rotation of pre-registration roller 53A is started (S15) in the same way as in the foregoing, the succeeding recording sheet stopped momentarily at pre-registration roller 53A is conveyed at the speed of V1. In this case, with regard to conditions for reconveyance for the succeeding recording sheet, it is judged whether or not conditions for reconveyance are prepared in accordance with the state of conveyance for the preceding recording sheet, which is different from the case stated above. Namely, in the present embodiment, reconveyance by pre-registration roller 53A is started in accordance with information of the leading edge of the preceding recording sheet detected by the fourth sensor S4. In describing in detail, the driving of pre-registration roller 53A is started (S33) after the lapse (S32) of prescribed time t6 sec) from the moment (S25) when the leading edge of the preceding recording sheet reconveyed by registration roller 56 is detected by the fourth sensor S4. In this case, the preceding recording sheet is conveyed at the speed of V2 (=Vp), while the succeeding recording sheet is conveyed at the speed of V1 (>V2). Therefore, this prescribed time (t6 sec) does not allow the leading edge of the succeeding recording sheet reconveyed by pre-registration roller 53 to catch up with the trailing edge of the preceding recording sheet reconveyed by registration roller 56. In other words, the prescribed time makes the succeeding recording sheet to reach registration roller 56 after the preceding recording sheet has passed through the registration roller 56 completely.

For reconveying the succeeding recording sheet, rotation of intermediate conveyance roller 541 is started, simultaneously with the start of rotation of pre-registration roller 53A (S15), so that the recording sheet may be conveyed at the speed of V1 in the same way as in the foregoing. Namely, after t4 sec from the moment when the leading edge of the preceding recording sheet is detected by the third sensor S3, the driving of intermediate conveyance roller 541 which was stopped simultaneously with loop forming roller 55 is started concurrently with the start of driving of pre-registration roller 53A (S15).

On the other hand, driving of loop forming roller 55 for conveying the succeeding recording sheet is different from that of intermediate conveyance roller 541. The basis for this is that when the driving of pre-registration roller 53A is started (S15), loop forming roller 55 is still conveying the preceding recording sheet, and the conveyance speed for the succeeding recording sheet is V1, while the conveyance speed for the preceding recording sheet is V2. Therefore, when conveyance of the preceding recording sheet by registration roller 55 is completed, registration roller 55 is controlled so that it rotates for conveyance of the succeeding recording sheet. Namely, in the present embodiment, the speed of rotation of loop forming roller 55 is changed in accordance with information of the leading edge of the preceding recording sheet detected by the fourth sensor S4. In description in detail, the peripheral speed for rotation of loop forming roller 55 is changed from V2 to V1 (S35) after the lapse (S34) of prescribed time (t8 sec) from the moment when the leading edge of the preceding recording sheet reconveyed by registration roller 56 and loop forming roller 55 is detected by the fourth sensor S4 (S25).

Incidentally, in the present embodiment, the peripheral speed V2 of loop forming roller 55 is changed to the peripheral speed V1 for the purpose of improving the number of sheets of image forming per unit time (productivity), namely, for the purpose of narrowing the interval between the preceding recording sheet and the succeeding recording sheet at the position of image forming means 3. However, it is also possible to make the prescribed time (t6 sec) for the start of driving (S33) of pre-registration roller 53A to be longer, and to start driving loop forming roller 55 at the peripheral speed Vi in synchronization with the start of driving of pre-registration roller 53A (S33), after stopping the loop forming which is rotating at the peripheral speed V2.

Then, the succeeding recording sheet conveyed at the speed V1 by pre-registration roller 53A, intermediate conveyance roller 541 and loop forming roller 55 is made to hit registration roller 56. In this case, registration roller 56 is arranged so that its rotation is stopped (S37) when the trailing edge of the preceding recording sheet conveyed at the speed V2 is detected by the fourth sensor S4 (S36). Therefore, the succeeding recording sheet hits registration roller 56 which is not rotating.

In this case, loop forming roller 55 and intermediate conveyance roller 541 are stopped in terms of rotation (S40) after the lapse of prescribed time (t4 sec) from the moment when the leading edge of the succeeding recording sheet is detected by the third sensor S3 (S39), in the same way as in the foregoing. Therefore, the succeeding recording sheet whose leading edge is stopped by registration roller 56 is further conveyed by loop forming roller 56, and a loop is formed between registration roller 56 and loop forming roller 55, in the same way as in the foregoing.

Then, the succeeding recording sheet stops after its loop is formed by registration roller 56 and loop forming roller 55, and then is reconveyed by registration roller 56 in accordance with information of the trailing edge of the preceding recording sheet detected by the fourth sensor S4. Namely, after the lapse of prescribed time (t7 sec) (S38) from the moment when the trailing edge of the preceding recording sheet is detected by the fourth sensor S4 (S36), signals to start driving the registration roller are outputted from the control means, and registration roller 56 and loop forming roller 55 are started to rotate based on the signals mentioned above (S24), in the same way as in the foregoing. In this case, the peripheral speed for rotation of registration roller 56 and loop forming roller 55 is V2 which is the same as process speed Vp at which the image forming is conducted by image forming means 3.

In the present embodiment, a recording sheet is conveyed from recording sheet housing means 4A at the speed V1 which is higher than process speed Vp, and then, the recording sheet is conveyed to image forming means 3 at the speed V2 which is the same as process speed Vp, as stated above. Therefore, it is possible to narrow an interval between the preceding recording sheet and the succeeding recording sheet at the position of image forming means 3, and thereby to improve productivity without increasing the process speed so much. Since the process speed is not increased so much, it is not necessary to increase strength of the housing of an image forming apparatus, which makes it possible to realize low cost. Further, when various types of recording materials are used, it is possible to secure the sufficient time to absorb dispersion of conveyance timing for feeding out of recording sheet housing means 4A, and thereby to eliminate the dispersion of conveyance timing.

From the another viewpoint in the present embodiment, when plural recording sheets are conveyed by conveyance means 5, a distance between the trailing edge of the preceding recording sheet reconveyed by registration roller 56 and the leading edge of the succeeding recording sheet at the moment of the start of reconveyance by registration roller 56 is longer than that between the trailing edge of the preceding recording sheet and the leading edge of the succeeding recording sheet at the moment when the preceding recording sheet has passed through registration roller 56. From the further another viewpoint in the present embodiment, when plural recording sheets are conveyed by conveyance means 5 (in detailed description, when the preceding recording sheet is conveyed by registration roller 56, and the succeeding recording sheet is also conveyed by another conveyance means), a distance between the trailing edge of the preceding recording sheet reconveyed by registration roller 56 and the leading edge of the succeeding recording sheet is shortened with the lapse of time. Therefore, the succeeding recording sheet can hit registration roller 56 earlier, whereby, it is possible not only to secure accurate conveyance timing but also to narrow the interval of recording sheets reconveyed from registration roller 56, which makes it possible to improve productivity.

In the present embodiment, a period of time for which a recording sheet is stopped by pre-registration roller 53 is established to be longer than the time period for a recording sheet to be stopped by registration roller 56. Namely, since the time for stoppage by pre-registration roller 53 representing a stopper means at the upstream side is longer, it is possible to eliminate dispersion of conveyance earlier at the upstream side where dispersion of conveyance tends to occur most likely when various types of recording materials are used, which makes it possible to conduct accurate conveyance. The time for stoppage mentioned here is a period of time covering from the moment when the leading edge of the recording sheet hits registration roller 56 or pre-registration roller 53 to the moment when reconveyance is started (a period of time for which the leading edge of the first or second sheet keeps to be horizontal in FIG. 10). For measurement of the time for stoppage, a recording sheet recommended for the image forming apparatus among various types of recording sheets usable in the image forming apparatus is used. This is from the ground that when a recording sheet other than the recommended one is used, there is a possibility that conveyance varies greatly and the time for stoppage fluctuates, and to absorb this fluctuation, the time for stoppage by registration roller 56 is made to be different from that by pre-registration roller 53 (accurate measurement of time is possible for the recommended recording sheet because the time for stoppage fluctuates less).

Figure 11:
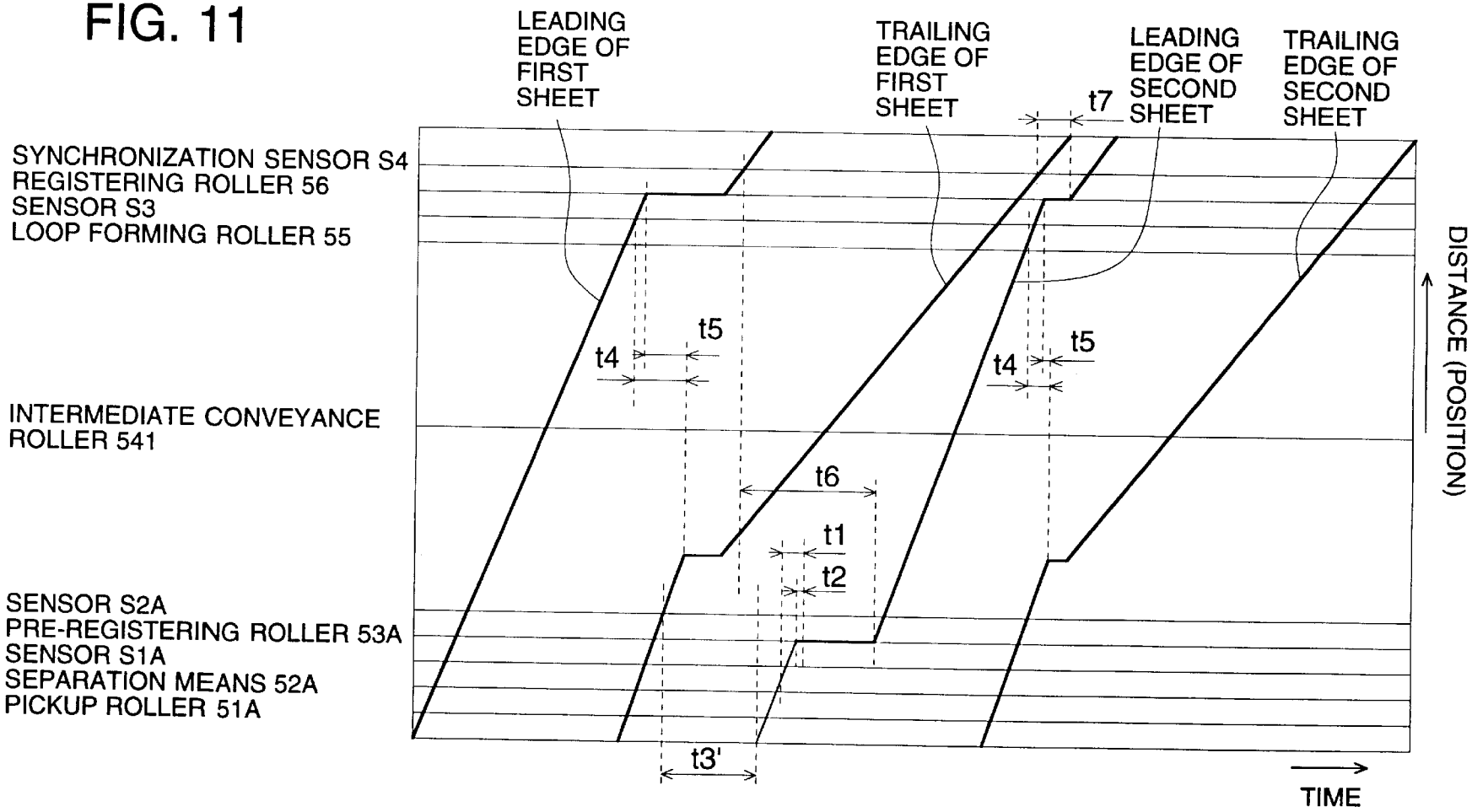
FIG. 11 is a timing chart showing illustratively the position of a recording sheet in another embodiment.

Incidentally, in the present embodiment described in detail above, when plural recording sheets are conveyed continuously, even the first recording sheet is made to hit pre-registration roller 53 to be stopped and reconveyed by it, and then, is made to hit registration roller 56 to be stopped and reconveyed by it. As far as the first recording sheet is concerned, however, as shown in FIG. 11, it is also possible to make the first recording sheet to hit pre-registration roller 53 to be conveyed without being stopped. In this case, it is possible to convey the first recording sheet earlier, and thereby to form images on the first recording sheet earlier. Namely, for the first recording sheet which has no preceding recording sheet, it is not necessary to consider the sheet internal with the preceding recording sheet, and no excessive control is made, while for the second succeeding recording sheet and thereafter which require consideration of sheet internal with the preceding recording sheet, hitting, stoppage and reconveyance in plural times are conducted to make the conveyance timing accurate. Due to this, it is possible not only to expedite the conveyance for the first recording sheet but also to make the sheet interval between the first recording sheet and the second recording sheet to be accurate, which makes it possible to improve productivity.

In this case, it is preferable that the time for stoppage of the first recording sheet is longer than that of the second recording sheet, with regard to the time for stoppage of a recording sheet by registration roller 56, as shown in FIG. 11. The ground for this is that big conveyance dispersion caused by the first recording sheet which does not hit pre-registration roller 53 and is not stopped by it can be absorbed registration roller 56, and conveyance dispersion for the second recording sheet which hits pre-registration roller 53 and is stopped by it is less, and the time for stoppage by registration roller 56 is made shorter compared with the first recording sheet, thus, high productivity can be realized.

In the case that the time for stoppage of the first recording sheet is longer than that of the second recording sheet with regard to the time for stoppage of a recording sheet by registration roller 56 as described above, the pickup roller S5A starts feeding the second sheet a predetermined time t3' after the trailing edge of the first sheet is detected by the sensor S2A positioned downstream of the preregistration roller 53, wherein the predetermined time t3' is determined in accordance with the time period during which the first sheet is stopped at the registration roller 56.

In the present embodiment, though two of pre-registration roller 53 and first loop forming means (separation means 52) and registration roller 56 and loop forming roller 55 are provided on a conveyance path from each of recording sheet housing means 4A–4C, three of them may naturally be provided. In particular, in the conveyance of recording sheet from the second recording sheet housing means 4B or the third recording sheet housing means 4C where the distance of the conveyance path is longer, greater effect can be expected if they are provided on intermediate conveyance path b, because dispersion of conveyance timing and sheet skewing are caused more because the conveyance distance is longer.

As stated in detail above, the invention makes it possible to provide an image forming apparatus which is capable of improving productivity, or is capable of conveying a recording material accurately without causing any dispersion.

As described in detail above, the invention makes it possible to provide an image forming apparatus and a recording material conveyance method, wherein dispersion of conveyance is restrained, or skewing of a recording material is restrained, and image forming can be carried out satisfactorily at an accurate position on the recording material, or to clear sheet jamming easily and surely.

What is claimed is:

1. An image forming apparatus comprising:

a plurality of storing units for storing respective recording materials of various sizes;

a plurality of feeding members for feeding out the recording materials from each of the storing units;

a conveyance path along which the recording materials being fed out by each of the feeding members are conveyed;

a plurality of conveying members for conveying the recording materials along the conveyance path;

an image forming section for forming an image on the recording materials conveyed along the conveyance path; and a plurality of first regulators provided at respective predetermined positions with respect to corresponding ones of each of the storing units for regulating at least a maximum size of the various sizes of the recording materials while at least at a part of each of the recording materials is fed out from the respective corresponding storing units.

2. The image forming apparatus of claim 1, wherein each of the first regulators comprises a stopper member for stopping the recording material being conveyed along the conveyance path so as to control a timing for conveying the recording material, and the stopper member releases the recording material when a predetermined time passes after the recording material is stopped.

3. The image forming apparatus of claim 2, wherein each of the feeding members continues feeding operation of the recording material after the recording material comes in contact with one of the stopper members so as to correct skewing of the recording material, and the stopper member releases the recording material when the predetermined time passes after the recording material comes in contact with the stopper member.

4. The image forming apparatus of claim 1, wherein each of the feeding members comprises a feed out member for feeding out the recording material from one of the storing units and a double feed prevention member for preventing double feeding of the recording material and for conveying the recording material.

5. The image forming apparatus of claim 4, wherein each of the first regulators comprise a stopper member for stopping the recording material being conveyed along the conveyance path, and each of the double feed prevention members continues conveying operation of the recording material after the recording material comes in contact with one of the stopper members so as to correct skewing of the recording material; wherein the stopper member releases the recording material when a predetermined time passes after the recording material comes in contact with the stopper member.

6. The image forming apparatus of claim 1, further comprising a plurality of first detectors, each of which is provided at an upstream position on the conveyance path relative to a respective one of the first regulators, for detecting the recording material being conveyed along the conveyance path;

wherein each of the feeding members stops feeding operation of the recording material according to a detection of the recording material by each of the first detectors.

7. The image forming apparatus of claim 6, further comprising a plurality of second detectors, each of which is provided on the conveyance path at a downstream position relative to each of the first regulators, for detecting the recording material being conveyed along the conveyance path; wherein one of the feeding members restarts feeding operation of the recording material according to a detection of the recording material by each of the second detectors.

8. The image forming apparatus of claim 1, wherein each of the first regulators is capable of being drawn out of the image forming apparatus with the respective storing unit corresponding thereto.

9. The image forming apparatus of claim 1, wherein a first conveyance speed at which the recording material is fed out by the feeding members is higher than a second conveyance speed at which the recording material is conveyed in the image forming section.

10. The image forming apparatus of claim 1, wherein each of the first regulators comprises a pair of conveying rollers.

11. The image forming apparatus of claim 1, further comprising a second regulator, which is provided on the conveyance path and between the first regulators and the image forming section, for regulating the recording material being conveyed along the conveyance path.

12. The image forming apparatus of claim 11, wherein the conveyance path comprises a plurality of first conveyance paths on which each of the first regulators is provided, a second conveyance path on which the second regulator is provided and an intermediate conveyance path provided between the first conveyance paths and the second conveyance path.

13. The image forming apparatus of claim 12, wherein each of the first regulators and the second regulator comprises a stopper member for stopping the recording material being conveyed along each of the first conveyance paths and the second conveyance path so as to control a timing for conveying the recording material, and each of the stopper members releases the recording material when a predetermined time passes after the recording material is stopped.

14. The image forming apparatus of claim 13, wherein each of the conveying members is provided at an upstream position on the second conveyance path relative to the second regulator and the feeding members continue conveying operation of the recording material after the recording material comes in contact with one of the stopper members so as to correct skewing of the recording material, and the stopper member releases the recording material when the predetermined time passes after the recording material comes in contact with the stopper member.

15. The image forming apparatus of claim 14, further comprising a plurality of first detectors, each of which is provided at an upstream position on a respective one of the first conveyance paths relative to a respective one of the first regulators, for detecting the recording material being conveyed along each of the first conveyance paths;

wherein each of the feeding members stops feeding operation of the recording material according to a detection of the recording material by each of the first detectors.

16. The image forming apparatus of claim 15, further comprising a plurality of second detectors, each of which is provided at a downstream position on a respective one of the first conveyance paths relative to a respective one of the first regulators, for detecting the recording material being conveyed along each of the first conveyance paths;

wherein one of the feeding members restarts feeding operation of the recording material according to a detection of the recording material by each of the second detectors.

17. The image forming apparatus of claim 16, further comprising a third detector, which is provided at an upstream position on the second conveyance path relative to the second regulator, for detecting the recording material being conveyed along the second conveyance path;

wherein the conveyance member provided at an upstream position on the second conveyance path stops conveying operation of the recording material according to a detection of the recording material by the third detector.

18. The image forming apparatus of claim 17, further comprising:

a fourth detector, which is provided at a downstream position on the second conveyance path relative to the second regulator, for detecting the recording material being conveyed along the second conveyance path;

wherein an intermediate conveying member, which is provided on the intermediate conveyance path and which is one of the conveying members, is controlled according to a detection of the recording material by the fourth detector.

19. The image forming apparatus of claim 11, wherein a first conveyance speed at which the recording material is conveyed in an upstream part relative to the second regulator is higher than a second conveyance speed at which the recording material is conveyed in a downstream part relative to the second regulator.

20. The image forming apparatus of claim 11, wherein the recording material conveyed along the conveyance path is stopped at least two times by the first regulators and the second regulator, wherein each of the first regulators forbids stopping a first recording material when the recording materials are conveyed continuously and each of the first regulators stops a second recording material, and the second regulator stops every recording material when the recording materials are conveyed continuously.

21. The image forming apparatus of claim 20, wherein a first stopping time for which the first recording material is stopped by the second regulator is longer than a second stopping time for which each of recording materials except for the first recording material is stopped by the second regulator when the recording materials are conveyed continuously.

22. The image forming apparatus of claim 11, wherein the recording material conveyed along the conveyance path is stopped at least two times by the first regulators and the second regulator, and a stopping time for which the recording material is stopped by each of the first regulators is longer than a stopping time for which the recording material is stopped by the second regulator.

23. The image forming apparatus of claim 11, wherein the second regulator comprises a pair of conveying rollers.

24. An image forming apparatus, comprising:

a plurality of storing units for storing recording materials;

an image forming section for conducting an image forming on the recording materials;

a conveying device for conveying the recording materials from each of the plurality of storing units to the image forming section along a conveyance path;

wherein the conveying device comprises a plurality of first stopper members for stopping the recording materials conveyed from each of the storing units, and wherein each of the plurality of first stopper members is provided with respect to a corresponding one of each of the plurality of storing units.

* * * * *